United States Patent [19]

Ringgenberg

[11] Patent Number: 4,711,305

[45] **Date of Patent: * Dec. 8, 1987**

[54] MULTI-MODE TESTING TOOL AND METHOD OF TESTING

[75] Inventor: Paul D. Ringgenberg, Duncan, Okla.

[73] Assignee: Halliburton Company, Duncan, Okla.

[ * ] Notice: The portion of the term of this patent subsequent to Jan. 6, 2004 has been disclaimed.

[21] Appl. No.: 948,340

[22] Filed: Dec. 31, 1986

Related U.S. Application Data

[63] Continuation of Ser. No. 596,321, Apr. 3, 1984, Pat. No. 4,633,952.

[51] Int. Cl.[4] ..... E21B 49/08; E21B 34/10

[52] U.S. Cl. ..... 166/336; 166/250; 166/264; 166/321; 166/373

[58] Field of Search ..... 166/162, 169, 240, 250, 166/264, 320, 321, 331, 336, 373, 374, 386

[56] References Cited

U.S. PATENT DOCUMENTS

| | | | |
|---|---|---|---|
| Re. 29,562 | 3/1978 | Wray et al. | 166/162 |
| Re. 29,638 | 5/1978 | Nutter | 166/128 |
| 3,051,240 | 8/1962 | Fisher, Jr. | 166/331 |
| 3,646,995 | 3/1972 | Manes et al. . | |
| 3,796,261 | 3/1974 | Nutter | 166/237 |
| 3,823,773 | 7/1974 | Nutter | 166/250 |
| 3,850,250 | 11/1974 | Holden et al. | 166/226 |
| 3,856,085 | 12/1974 | Holden et al. | 166/264 |
| 3,858,649 | 1/1975 | Wray et al. | 166/162 |
| 3,860,066 | 1/1975 | Pearce et al. . | |
| 3,891,033 | 6/1975 | Scott | 166/133 |
| 3,897,825 | 8/1975 | Tausch | 166/321 |
| 3,901,314 | 8/1975 | Nutter | 166/152 |
| 3,915,228 | 10/1975 | Giebeler . | |
| 3,964,544 | 6/1976 | Farley et al. | 166/264 |
| 3,970,147 | 7/1976 | Jessup et al. | 166/250 |
| 3,976,136 | 8/1976 | Farley et al. | 166/264 |
| 3,986,554 | 10/1976 | Nutter | 166/240 |
| 4,047,564 | 9/1977 | Nix et al. . | |
| 4,063,593 | 12/1977 | Jessup | 166/317 |
| 4,064,937 | 12/1977 | Barrington | 166/162 |
| 4,083,409 | 4/1978 | Barrington . | |
| 4,105,075 | 8/1978 | Helmus | 166/321 |
| 4,109,724 | 8/1978 | Barrington | 166/321 |
| 4,109,725 | 8/1978 | Williamson et al. | 166/321 |
| 4,113,012 | 9/1978 | Evans et al. | 166/264 |
| 4,113,018 | 9/1978 | Barrington et al. . | |
| 4,125,165 | 11/1978 | Helmus | 166/323 |
| 4,144,937 | 3/1979 | Jackson et al. | 166/314 |
| 4,258,793 | 3/1981 | McGraw et al. . | |
| 4,270,610 | 6/1981 | Barrington | 166/317 |
| 4,281,715 | 8/1981 | Farley . | |
| 4,295,361 | 10/1981 | McMahan | 166/323 |
| 4,311,197 | 1/1982 | Hushbeck | 166/323 |
| 4,319,633 | 3/1982 | McMahan et al. | 166/250 |
| 4,319,634 | 3/1982 | McMahan et al. | 166/250 |
| 4,324,293 | 4/1982 | Hushbeck | 166/317 |
| 4,328,866 | 5/1982 | Zimmerman . | |
| 4,341,266 | 7/1982 | Craig | 166/317 |
| 4,355,685 | 10/1982 | Beck | 166/240 |
| 4,399,870 | 8/1983 | Baugh et al. | 166/324 |
| 4,403,659 | 9/1983 | Upchurch | 166/374 |
| 4,421,172 | 12/1983 | McMahan | 166/334 |
| 4,422,506 | 12/1983 | Beck | 166/324 |
| 4,429,748 | 2/1984 | Beck | 166/324 |
| 4,444,267 | 4/1984 | Beck . | |
| 4,444,268 | 4/1984 | Barrington . | |
| 4,445,571 | 5/1984 | Hushbeck . | |
| 4,448,254 | 5/1984 | Barrington . | |
| 4,452,313 | 6/1984 | McMahan . | |
| 4,458,762 | 7/1984 | McMahan . | |
| 4,474,242 | 10/1984 | Upchurch . | |
| 4,489,786 | 12/1984 | Beck . | |
| 4,498,536 | 2/1985 | Ross et al. | 166/250 |
| 4,502,537 | 3/1985 | Carter, Jr. . | |
| 4,515,219 | 5/1985 | Beck . | |
| 4,522,266 | 6/1985 | Barrington . | |
| 4,633,952 | 1/1987 | Ringgenberg | 166/336 |

*Primary Examiner*—Stephen J. Novosad
*Assistant Examiner*—William P. Neuder
*Attorney, Agent, or Firm*—James R. Duzan

[57] ABSTRACT

A multi-mode testing tool operable as a drill pipe tester, formation tester, nitrogen displacement valve or circulation valve. Tool mode is changed responsive to pressure cycling in the well bore. A ball valve in the tool bore may also be operated by pressure cycling when the tool is in its formation tester mode. Also disclosed is a pressure responsive double-acting piston power mechanism, and a ball and slot ratchet assembly.

9 Claims, 39 Drawing Figures

MULTI-MODE TESTING TOOL AND METHOD OF TESTING

This application is a continuation, of application Ser. No. 596,321, filed Apr. 3, 1984 now U.S. Pat. No. 4,633,952.

BACKGROUND OF THE INVENTION

Well testing and stimulation operations are commonly conducted on oil and gas wells in order to determine production potential and to enhance same if possible. In flow testing a well, a tester valve is lowered into the well on a string of drill pipe above a packer. After the packer is set, the tester valve is opened and closed periodically to determine formation flow, pressure, and rapidity of pressure recovery.

Also generally included in a testing string are a drill pipe tester valve and a circulation valve above the tester valve, the former to permit testing the pressure integrity of the string prior to conducting the test, and the latter to permit the circulation of formation fluids out of the string after the test is completed.

It is desirable, particularly when conducting tests on offshore wells, to employ a testing string which requires a minimum rotation or reciprocation of the drill pipe to operate the tools therein, so as to keep the well blowout preventers closed during the majority of the operation. So-called annulus pressure responsive downhole tools have been developed, which tools operate responsive to pressure changes in annulus between the testing string and the well bore casing. A number of these annulus pressure responsive tools are disclosed in the following patents assigned to the assignee of the present invention. For example, testing valves are disclosed in U.S. Pat. Nos. 3,858,649, 3,856,085, 3,976,136, 3,964,544, 4,144,937, 4,422,506, and 4,429,748. Circulation valves are disclosed in U.S. Pat. Nos. 3,850,250, 3,970,147, 4,113,012, 4,324,293 and 4,355,685. It is also known to operate a tool to take a sample of formation fluid with annulus pressure, as disclosed in U.S. Pat. Nos. RE 29,562 and 4,063,593. Moreover, tools which combine multiple functions have also been developed, as disclosed in the aforesaid U.S. Pat. No. RE 29,562 (testing and sampling) and U.S. Pat. Nos. 4,064,937, 4,270,610 and 4,311,197 (circulating and sampling). While many of the aforesaid tools provide a biasing source comprising an inert gas under pressure to oppose annulus pressure, it is also known to employ a compressible fluid, such as silicone oil, as disclosed in U.S. Pat. Nos. 4,109,724, 4,109,725, and U.S. application Ser. Nos 354,529 and 417,947. Moreover, the use of a compressed gas in combination with a fluid, such as oil, is disclosed in U.S. Pat. Nos. 4,422,506 and 4,429,748.

There exist other testing, circulating and sampling tools and the like which operate in response to annulus pressure, as disclosed in U.S. Pat. Nos. RE 29,638, 3,796,261, 3,823,773, 3,901,314, 3,986,554 and 4,403,659, assigned to Schlumberger Technology Corporation; U.S. Pat. Nos. 4,105,075 and 4,125,165, assigned to Baker International Corporation; U.S. Pat. No. 4,341,266, assigned to Lynes, Inc.; and U.S. Pat. No. 3,891,033 and 4,399,870, assigned to Hughes Tool Company.

Drill pipe tester valves which operate responsive to pipe string manipulation are disclosed in U.S. Pat. Nos. 4,295,361, 4,319,633, 4,319,634 and 4,421,172, all assigned to the assignee of the present invention.

While the tools of the prior art are diverse in design, they suffer from a number of deficiencies in actual operation. First, while several functions have been combined into one tool in some instances, the operation thereof depends upon use of multiple pressures, shearing of pins, or pressure variation both inside and outside the pipe string. Inability to maintain precise pressure levels hampers the use of some of these tools, while the use of shear pins prevents further operation of other tools after the pins have sheared. Many prior art tools employing therein a fluid such as oil utilize fluid metering means such as flow restrictors of a jet type exemplified by the Lee Visco Jet, described in U.S. Pat. No. 3,323,550, in conjunction with check valves. Such metering means and check valves are susceptible to clogging and often fail to operate properly if the fluid becomes contaminated or is of a low quality to begin with, a common occurrence in many remote areas of the world where these tools are operated. In addition, the use of fluid metering means requires an inordinate amount of time to cycle the prior art tools, thus prolonging time on the jobsite and cost to the well operator. Furthermore, temperature increases or decreases in the well bore from ambient surface temperatures change viscosity in the oils employed in these tools, thus affecting the performance of fluid metering means and altering tool cycling time. A further disadvantage resides with those tools utilizing oil, water or other liquids as an expendable fluid, as they are limited in the number of times they can be cycled downhole.

Finally, even though some attempts have been made to combine multiple functions in a single tool, there has heretofore been no successful combination of more than two functions in a single tool.

SUMMARY OF THE INVENTION

In contrast to the prior art, the present invention comprises a downhole tool which is capable of performing in different modes of operation as a drill pipe tester valve, a circulation valve and a formation tester valve, as well as providing its operator with the ability to displace fluids in the pipe string above the tool with nitrogen or another gas prior to testing or retesting. This latter function is a valuable advantage in testing of gas formations or other weak or low pressure formations which may not flow when subjected to a large hydrostatic head or which may even be damaged by the weight of fluid in the string when the formation tester valve is opened.

The tool of the present invention is operated by a ball and slot type ratchet mechanism which provides the desired opening and closing responsive to a series of annulus pressure increases and decreases of a drill pipe tester/formation tester valve, a circulation valve and a nitrogen displacement valve, as well as changing between the modes of tool operation in which each of these valves function. Moreover, the opening and closing as well as changing between tool modes is effected without requiring the accurate monitoring of pressure levels such as is necessary with tools that employ multiple pressure levels above a reference level or both pipe string and annulus pressures. The various tool modes are mutually exclusive, that is to say, only one mode is operative at a time to ensure, for example, that the circulation valve and tester valve cannot operate at the same time. In addition, the tool of the present invention is not limited to a given number of cycles in any of its modes, unlike prior art tools which employ shear pins or expendable fluids.

Further advantages over prior art tools include elimination of the need for a bypass below the tool since the design of the present invention precludes any operation of the circulating valve due to internal string pressure, including formation pressure from below the tool or acidizing or fracturing pressure from above applied to the formation. Conversely, circulating fluid under pressure is positively isolated from the formation below, due to the aforesaid "lock-out" feature which precludes opening of the tester valve in conjunction with the circulation valve. A further advantage of the circulation mode is the ability to circulate in either direction, so as to be able to spot chemicals or other fluids directly into the testing string bore from the surface, and then open the tester valve to treat the formation therewith. Also, pumping cold fluid through the tool will not prevent it from operating.

In addition to the advantages enumerated above, the present invention includes a novel and unobvious operating mechanism for fluid displacement in the tool which avoids the use of the flow restrictors and check valves of the prior art, such mechanism having utility in a wide variety of downhole tools, which employ pressure changes as a power source, and therefore not being so limited to the tool disclosed herein. Elimination of a fluid metering system greatly reduces tool cycling time and avoids the effects of viscosity changes in the metered fluid, as well as providing enhanced reliability. Another portion of the operating mechanism of the present invention includes a non-rotating ratchet sleeve and a rotating ball follower which enhances the reciprocation of the operating mandrel of the tool as disclosed, but which is also not so limited to that particular tool, having utility in other downhole tools as well.

It should be noted that the tool as disclosed is not limited to the four-mode (drill pipe tester, formation tester, circulation valve, nitrogen displacement valve) operation format. It may be employed in conjunction with another, independently actuated formation tester valve therebelow, and substitute an alternative ratchet slot program to operate in a three-mode (drill pipe tester, circulation valve, nitrogen displacement valve) format, or in a two-mode (circulation valve, nitrogen displacement valve) format.

BRIEF DESCRIPTION OF THE DRAWINGS

The present invention will be more fully understood by a review of the following detailed description of the preferred embodiment thereof, in conjunction with the accompanying drawings, wherein:

FIG. 6 comprises a development of the slot design employed in the preferred embodiment of the tool of the present invention.

FIGS. 8, 9 and 10 comprise alternative slot designs which may be employed to alter the mode-changing sequence in the tool of the present invention.

DETAILED DESCRIPTION OF THE PREFERRED EMBODIMENT OF THE INVENTION

Figure 1:
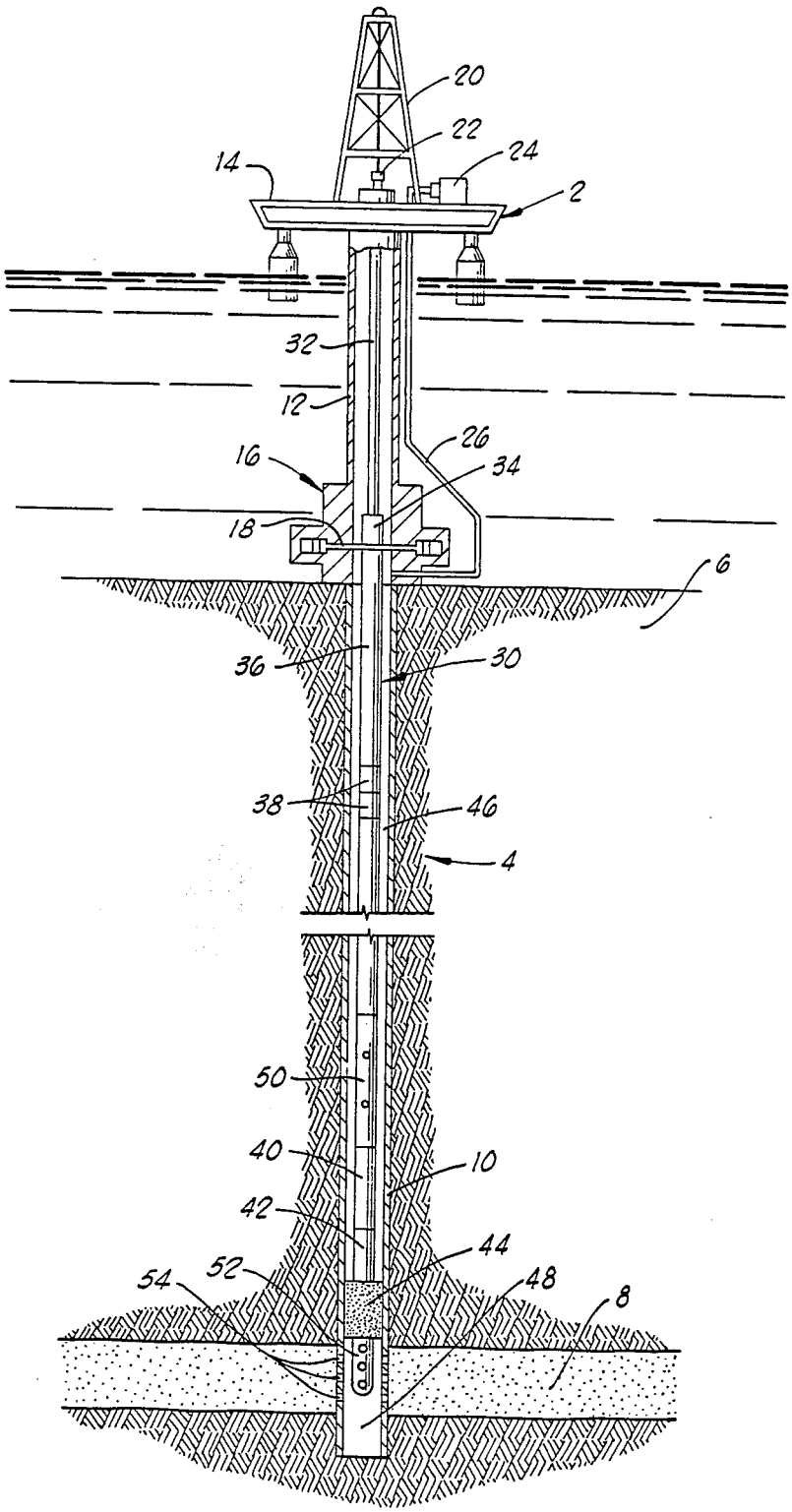
FIG. 1 provides a schematic vertically sectioned view of a representative offshore platform from which testing may be conducted and illustrates a formation testing string or tool assembly in a submerged well bore at the lower end of a string of drill pipe which extends upward to the platform.

Referring to FIG. 1, the present invention is shown schematically incorporated in a testing string deployed in an offshore oil or gas well. Platform 2 is shown positioned over a submerged oil or gas well bore 4 located in the sea floor 6, well bore 4 penetrating potential producing formation 8. Well bore 8 is shown to be lined with steel casing 10, which is cemented into place. A subsea conduit 12 extends from the deck 14 of platform 2 into a subsea wellhead 16, which includes blowout preventer 18 therein. Platform 2 carries a derrick 20 thereon, as well as a hoisting apparatus 22, and a pump 24 which communicates with the well bore 4 via control conduit 26, which extends below blowout preventer 18.

A testing string 30 is shown disposed in well bore 4, with blowout preventer 18 closed thereabout. Testing string 30 includes upper drill pipe string 32 which extends downward from platform 2 to wellhead 16, whereat is located hydraulically operated "test tree" 34, below which extends intermediate pipe string 36. Slip joint 38 may be included in string 36 to compensate for vertical motion imparted to platform 2 by wave action; slip joint 38 may be similar to that disclosed in U.S. Pat. No. 3,354,950 to Hyde. Below slip joint 38, intermediate string 36 extends downwardly to multi-mode testing tool 50 of the present invention. Below combination tool 50 is lower pipe string 40, extending to tubing seal assembly 42, which stabs into packer 44. When set, packer 44 isolates upper well bore annulus 40 from lower well bore annulus 48. Packer 44 may be any suitable packer well known in the art, such as, for example, a Baker Oil Tool Model D packer, an Otis Engineering Corporation Type W packer, or Halliburton Services CHAMP ®, RTTS or EZ DRILL ® SV packers. Tubing seal assembly 42 permits testing string 30 to communicate with lower well bore 48 through perforated tail pipe 52. In this manner, formation fluids from potential producing formation 8 may enter lower well bore 48 through the perforations 54 in casing 10, and be routed into testing string 30.

After packer 44 is set in well bore 4, a formation test controlling the flow of fluid from potential producing formation 8 through testing string 30 may be conducted using variations in pressure effected in upper annulus 46 by pump 24 and control conduit 26, with associated relief valves (not shown). Prior to the actual test, however, the pressure integrity of testing string 30 may be tested with the valve ball of the multi-mode tool closed in the tool's drill pipe tester mode. Tool 50 may be run into well bore 4 in its drill pipe tester mode, or it may be run in its circulation valve mode to automatically fill with fluid, and be cycled to its drill pipe mode thereafter. Formation pressure, temperature and recovery time may be measured during the flow test through the use of instruments incorporated in testing string 30 as known in the art as the ball valve in tool 50 of the present invention is opened and closed in its formation tester valve mode. Such instruments are well known in the art, and include both Bourdon tube-type mechanical gauges, electronic memory gauges, and sensors run on wireline from platform 2 inside testing string 30 prior to the test. If the formation to be tested is suspected to be weak and easily damageable by the hydrostatic head of fluid in testing string 30, tool 50 may be cycled to its displacement mode and nitrogen or other inert gas under pressure employed to displace fluids from the string prior to testing or retesting.

It may also be desirable to treat the formation 8 in conjunction with the testing program while testing string 30 is in place. Such a treating program is conducted by pumping various chemicals and other materials down the interior of testing string 30 at a pressure sufficient to force the chemicals and other materials into the formation, and to possibly fracture the formation. Of course, the chemicals, materials and pressures employed will vary depending on the formation characteristics and the desires changes thought to be effective in enhancing formation productivity. In this manner it is possible to conduct a testing program, treat the formation and a second testing program to determine treatment effectiveness without removal of testing string 30. If desired, treating chemicals may be spotted into testing string 30 from the surface by placing tool 50 in its circulation valve mode, and displacing string fluids into the annulus prior to opening the valve ball in tool 50.

At the end of the testing and treating programs, the circulation valve mode of tool 50 is employed, the circulation valve opened and formation fluids, chemicals and other injected materials in testing string 30 are circulated from the interior of testing string 30 into upper annulus 46 using a clean fluid, packer 44 is released (or tubing seal 42 withdrawn if packer 44 is to remain in place) and testing string 30 withdrawn from well bore 4.

Referring to FIGS. 2A–2H, tool 50 is shown in section, commencing at the top of the tool with upper adapter 100 having threads 102 therein at its upper end, whereby tool 50 is secured to drill pipe in the testing string. Upper adapter 100 is secured to nitrogen valve housing 104 at threaded connection 106, housing 104 containing a valve assembly (not shown), such as is well known in the art, in lateral bore 108 in the wall thereof, from which extends downwardly longitudinal nitrogen charging channel 110.

Valve housing 104 is secured by threaded connection 112 at its outer lower end to tubular pressure case 114, and by threaded connection 116 at its inner lower end to gas chamber mandrel 118, case 114 and mandrel 118 defining pressurized gas chamber 120 and upper oil chamber 122, the two being separated by floating annular piston 124.

The upper end of oil channel coupling 126 extends between case 114 and gas chamber mandrel 118, and is secured to the lower end of case 114 at threaded connection 128. A plurality of longitudinal oil channels 130 (one shown) extend from the upper end of coupling 126 to the lower end thereof. Radially drilled oil fill ports 132 extend from the exterior of tool 50, intersecting channels 130 and are closed with plugs 134. Annular shoulder 136 extends radially inward from inner wall 138 of coupling 126. The lower end of coupling 126, including annular overshot 127, is secured at threaded connection 140 to the upper end of ratchet case 142, through which oil fill ports 144 extend at annular shoulder 146, being closed by plugs 148. At the lower end of ratchet case 142 are additional oil fill ports 150 closed by plugs 152 and open pressure ports 154.

Ratchet slot mandrel 156 extends upward within the lower end of oil channel coupling 126. Annular ratchet chamber 158 is defined between mandrel 156 and case 142. The upper exterior 160 of mandrel 156 is of substantially uniform diameter, while the lower exterior 162 is of greater diameter so as to provide sufficient wall thickness for ratchet slots 164. There are preferably two such ratchet slots 164 of the configuration shown in FIG. 6 extending about the exterior of ratchet slot mandrel 156.

Ball sleeve assembly 166 surrounds ratchet slot mandrel 156, and comprises upper sleeve 168 including radially outwardly extending annular shoulder 170 having annular piston seat 172 thereon. Below shoulder 170, ratchet piston support surface 173 extends to the lower end of upper sleeve 168, which is overshot by the upper end of lower sleeve 174 having annular piston seat 176 thereon, and to which is secured at threaded connection 178. Ball sleeve 180 is disposed at the bottom of lower sleeve 174, and is secured thereto at swivel bearing race 182 by a plurality of bearings 184. Two ratchet balls 186 each extend into a ball seat 188 on diametrically opposite sides of ball sleeve 180 and into a ratchet slot 164 of semicircular cross-section. Due to this structure when balls 186 follow the path of slots 164, ball sleeve 180 rotates with respect to lower sleeve 174, the remainder of ball sleeve assembly 166 does not rotate, and only longitudinal movement is transmitted to ratchet mandrel 156 by balls 186.

Upper annular ratchet piston 190 and lower annular ratchet piston 192 ride on piston support surface 173 on upper sleeve 168, coil spring 194 being disposed therebetween. Upper ratchet piston 190 carries radial sealing surface 196 on its upper end, while lower ratchet piston 192 carries radial sealing surface 198 on its lower end.

The lower end 200 of ratchet slot mandrel 156 is secured at threaded connection 202 to extension mandrel 204 having relief ports 208 extending therethrough. Annular lower oil chamber 210 is defined by ratchet case 142 and extension mandrel 204. Annular floating piston 212 slidingly seals the bottom of lower oil chamber 210 and divides it from well fluid chamber 214 into which pressure ports 154 opens. The lower end of ratchet case 142 is secured at threaded connection 218, to extension case 216, which surrounds extension mandrel 204.

Circulation-displacement housing 220 is threaded at 222 to extension case 216, and possesses a plurality of circumferentially spaced radially extending circulation ports 224 as well as a plurality of nitrogen displacement ports 226 extending through the wall thereof.

Circulation valve sleeve 228 is threaded to extension mandrel 204 at 230. Valve apertures 232 extend through the wall of sleeve 228, and are isolated from circulation ports 224 by annular seal 234, which is disposed in seal recess 236 formed by the junction of circulation valve sleeve 228 with displacement valve sleeve 238, the two being threaded together at 240. The exterior of displacement valve sleeve 238 carries thereon downwardly facing radially extending annular shoulder 242 thereon, against which bears displacement spring 244. The lower exterior of displacement valve sleeve 238 is defined by displacement piston surface 246 upon which sliding annular displacement piston 248 rides. Annular valve surface 250 of piston 248, and seats on elastomeric valve seat 254. Nitrogen displacement apertures 256 extend through the wall of displacement valve sleeve 238. Valve seat 254 is pinched between sleeve 238 and shoulder 257 of sleeve 238 and flange 258 of operating mandrel 260, which is secured to sleeve 238 at threaded connection 262.

Seal carrier 264 surrounds mandrel 260 and the junction of mandrel 260 with sleeve 238 and is secured to mandrel 260 at threaded connection 265. Square cross-section annular seal 266 is carried on the exterior of mandrel 260 adjacent flange 258, and is secured in place by the upper end of seal carrier 264.

Below seal carrier 264, mandrel 260 extends downwardly to exterior annular recess 266, which separates annular shoulder 268 from the main body of mandrel 260.

Collet sleeve 270, having collet fingers 272 extending upward therefrom, engages operating mandrel 260 through the accommodation of radially inwardly extending protuberances 274 by annular recess 266. As is readily noted in FIG. 2G, protuberances 274 and the upper portions of fingers 272 are confined between the exterior of mandrel 260 and the interior of circulation-displacement housing 220.

At the lower end of collet sleeve 270, coupling 276 comprising flanges 278 and 280, with exterior annular recess 282 therebetween, grips coupling 284, comprising inwardly extending flanges 286 and 288 with interior recess 290 therebetween, on each of two ball operating arms 292. Couplings 276 and 284 are maintained in engagement by their location in annular recess 296 between ball case 294, which is threaded at 295 to circulation-displacement housing 220, and ball housing 298. Ball housing 298 is of substantially tubular configuration, having an upper smaller diameter portion 300 and a lower, larger diameter portion 302 which has two windows 304 cut through the wall thereof to accommodate the inward protrusion of lugs 306 from each of the two ball operating arms 292. Windows 304 extend from shoulder 311 downward to shoulder 314 adjacent threaded connection 316 with ball support 340. On the exterior of the ball housing 298, two longitudinal channels (location shown by arrow 308) of arcuate cross-section and circumferentially aligned with windows 304, extend from shoulder 310 downward to shoulder 311. Ball operating arms 292, which are of substantially the same arcuate cross-section as channels 308 and lower portion 302 of ball housing 298, lie in channels 308 and across windows 304, and are maintained in place by the interior wall 318 of ball case 294 and the exterior of ball support 340.

The interior of ball housing 298 possesses upper annular seat recess 320, within which annular ball seat 322 is disposed, being biased downwardly against ball 330 by ring spring 324. Surface 326 of upper seat 322 comprises a metal sealing surface, which provides a sliding seal with the exterior 332 of valve ball 330.

Valve ball 330 includes a diametrical bore 334 therethrough, of substantially the same diameter as bore 328 of ball housing 298. Two lug recesses 336 extend from the exterior 332 of valve ball 330 to bore 334.

The upper end 342 of ball support 340 extends into ball housing 298, and carries lower ball seat recess 344 in which annular lower ball seat 346 is disposed. Lower ball seat 346 possesses arcuate metal sealing surface 348 which slidingly seals against the exterior 332 of valve ball 330. When ball housing 298 is made up with ball support 340, upper and lower ball seats 322 and 346 are biased into sealing engagement with valve ball 330 by spring 324.

Exterior annular shoulder 350 on ball support 340 is contacted by the upper ends 352 of splines 354 on the exterior of ball case 294, whereby the assembly of ball housing 294, ball operating arms 292, valve ball 330, ball seats 322 and 346 and spring 324 are maintained in position inside of ball case 294. Splines 354 engage splines 356 on the exterior of ball support 340, and thus rotation of the ball support 340 and ball housing 298 within ball case 298 is prevented.

Lower adapter 360 protrudes at its upper end 362 between ball case 298 and ball support 340, sealing therebetween, when made up with ball support 340 at threaded connection 364. The lower end of lower adapter 360 carries on its exterior threads 366 for making up with portions of a test string below tool 50.

Figure 2A:
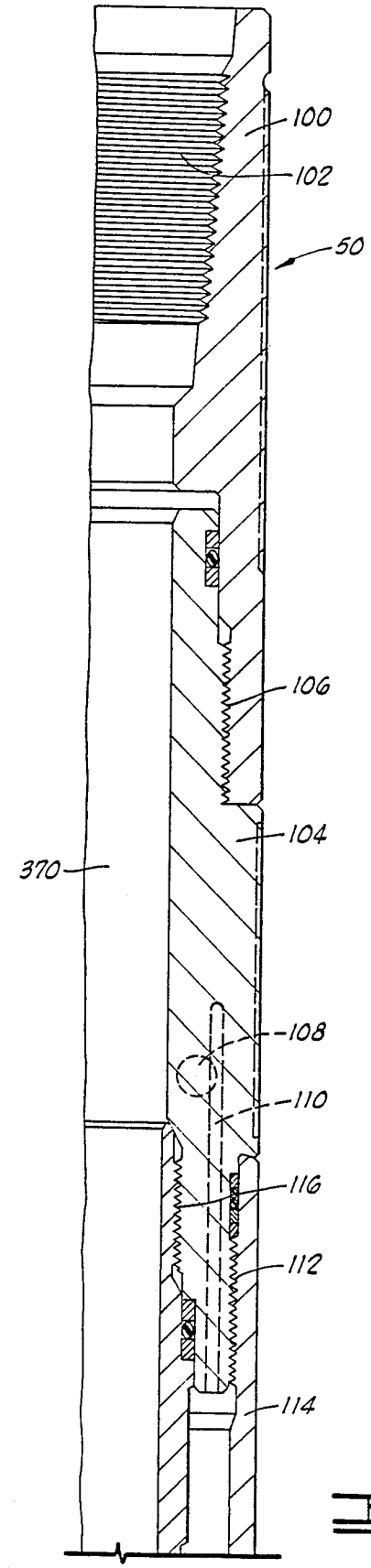
FIGS. 2A–2H comprise a vertical half-section of the tool of the present invention in a formation testing mode.
Figure 2B:
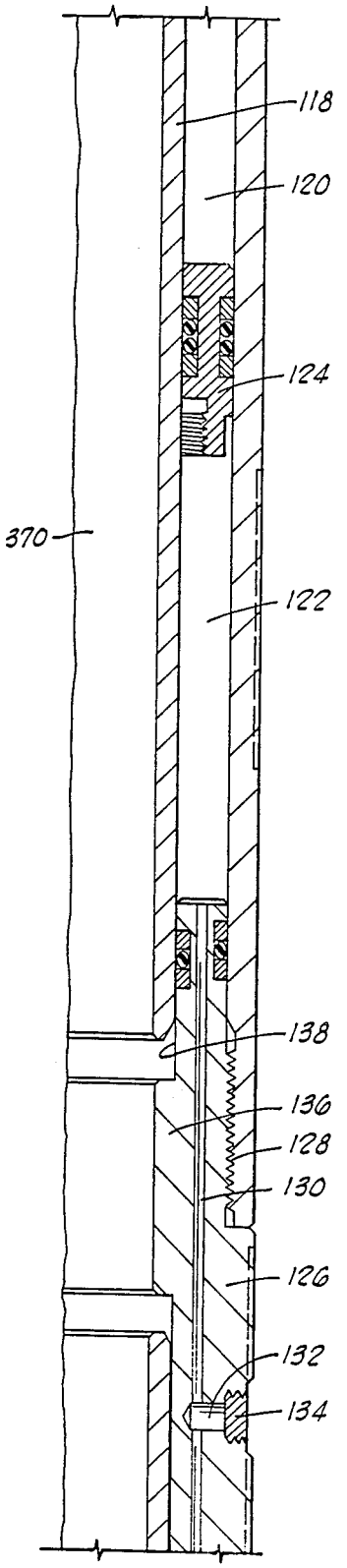
Figure 2C:
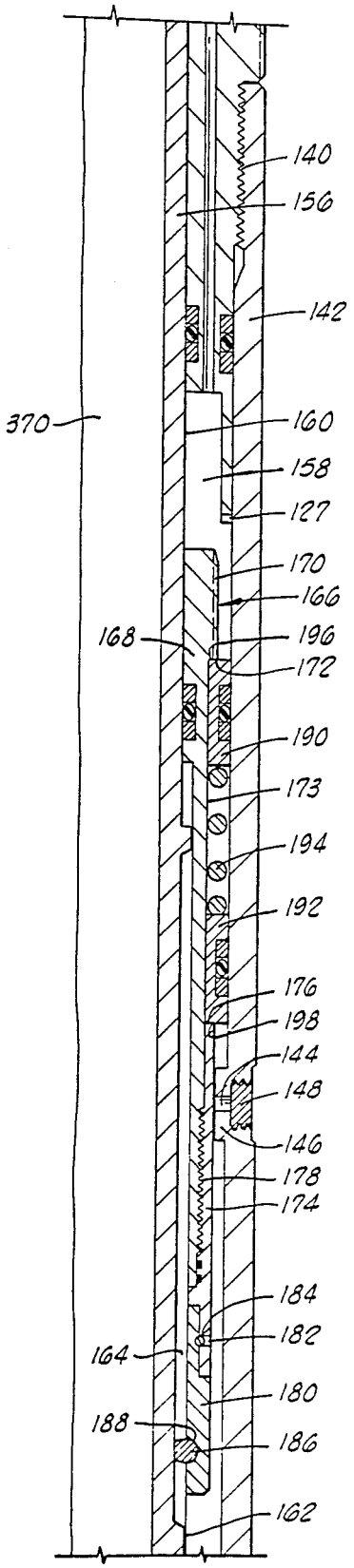
Figure 2D:
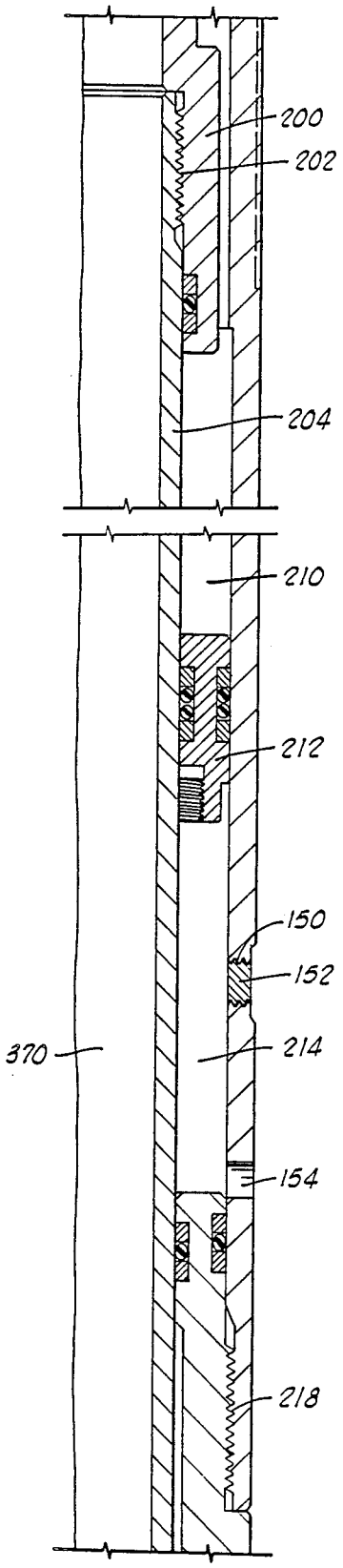
Figure 2E:
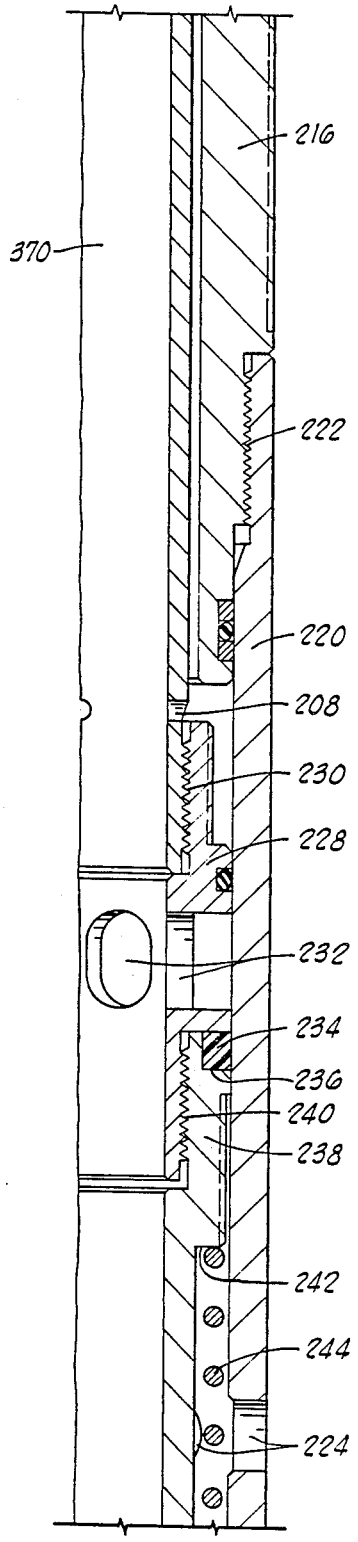
Figure 2F:
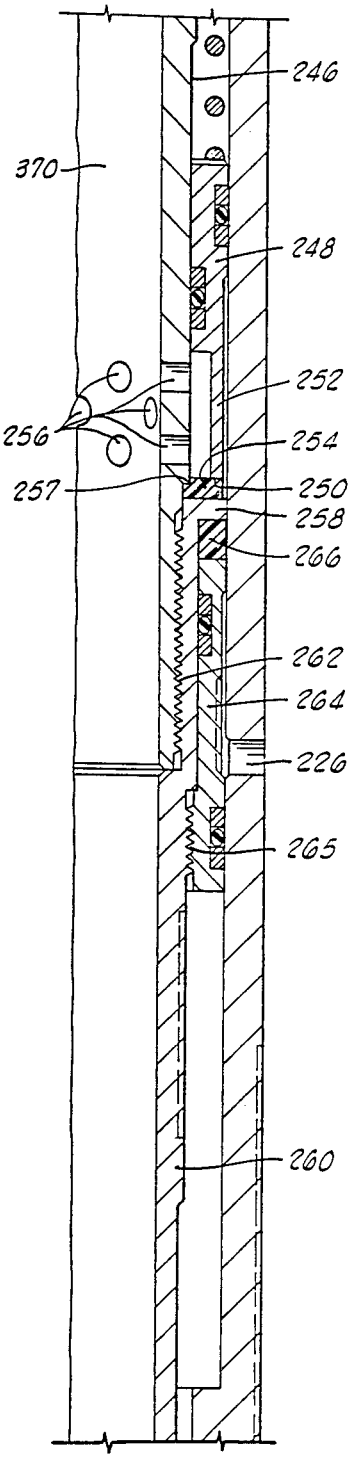
Figure 2G:
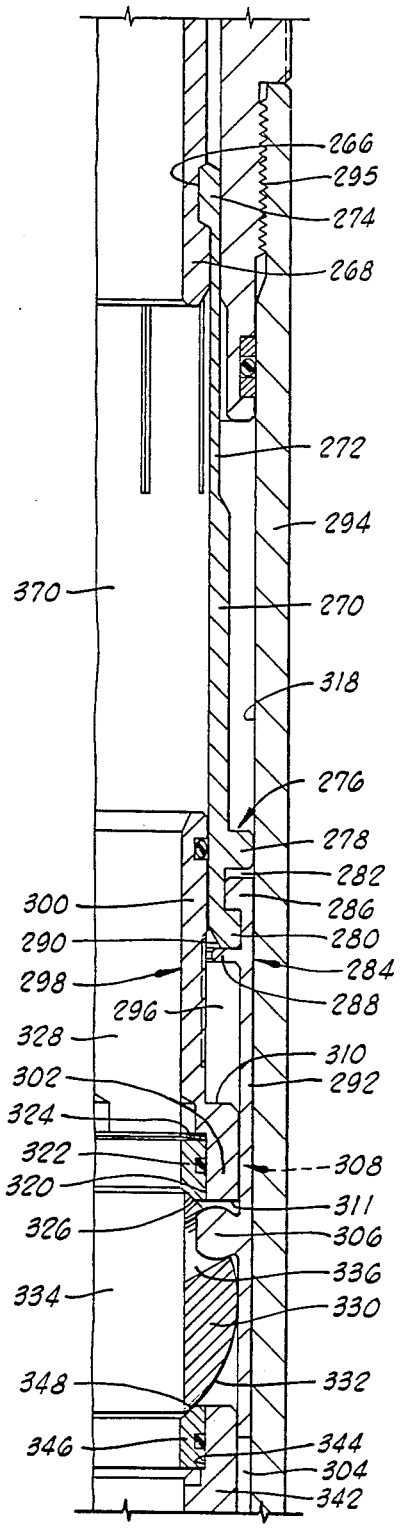
Figure 2H:
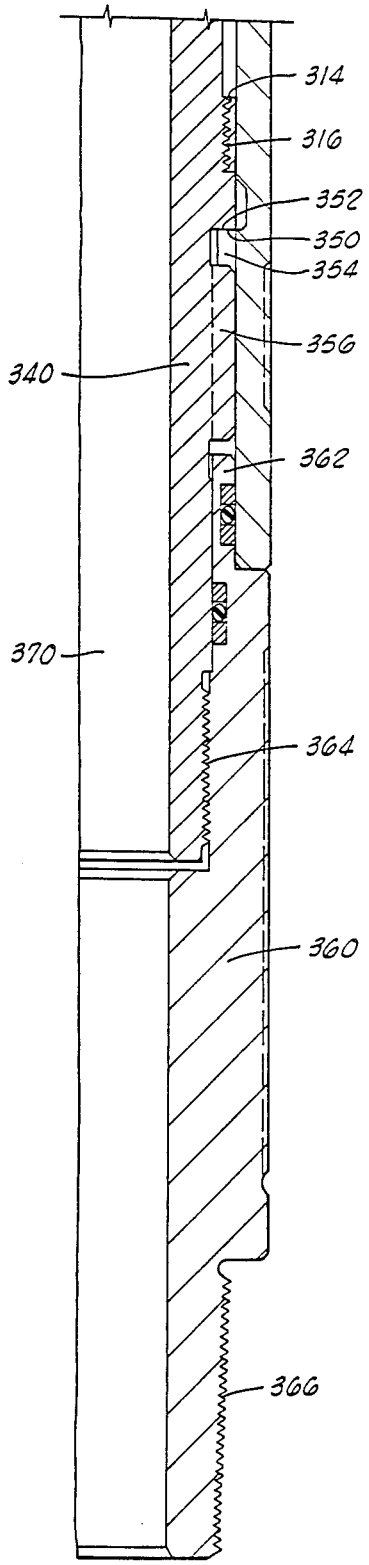
Figure 3A:
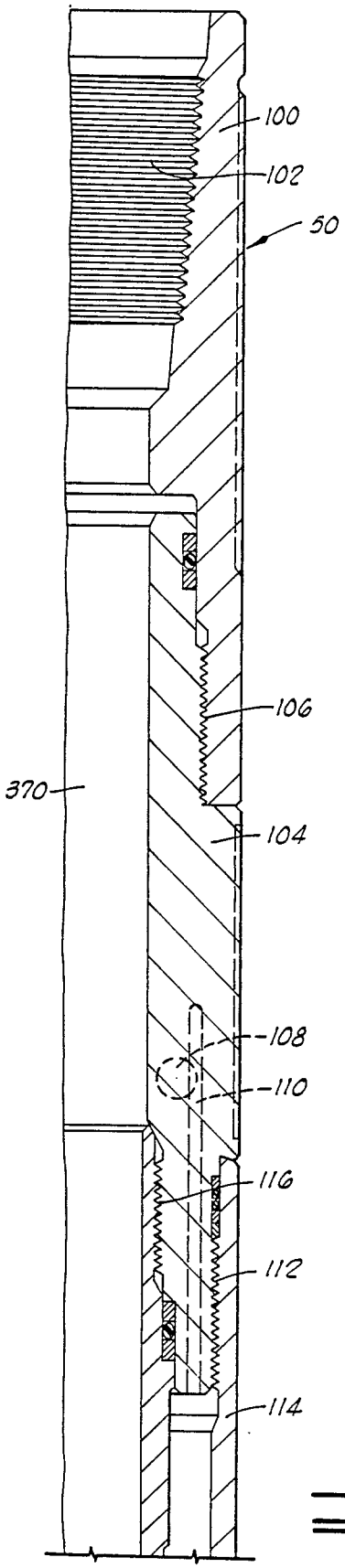
FIGS. 3A–3H comprise a vertical half-section of the tool of the present invention in a drill pipe testing mode.
Figure 3B:
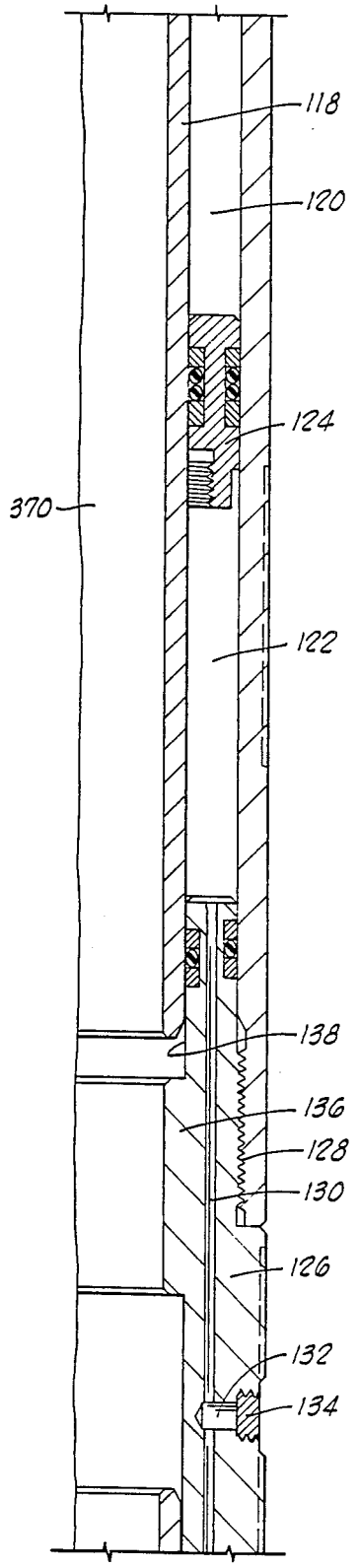
Figure 3C:
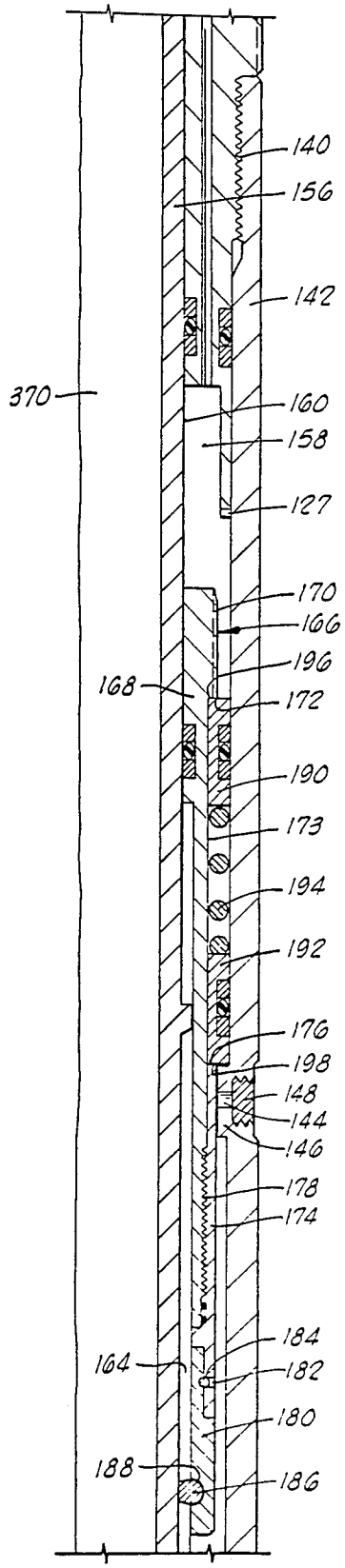
Figure 3D:
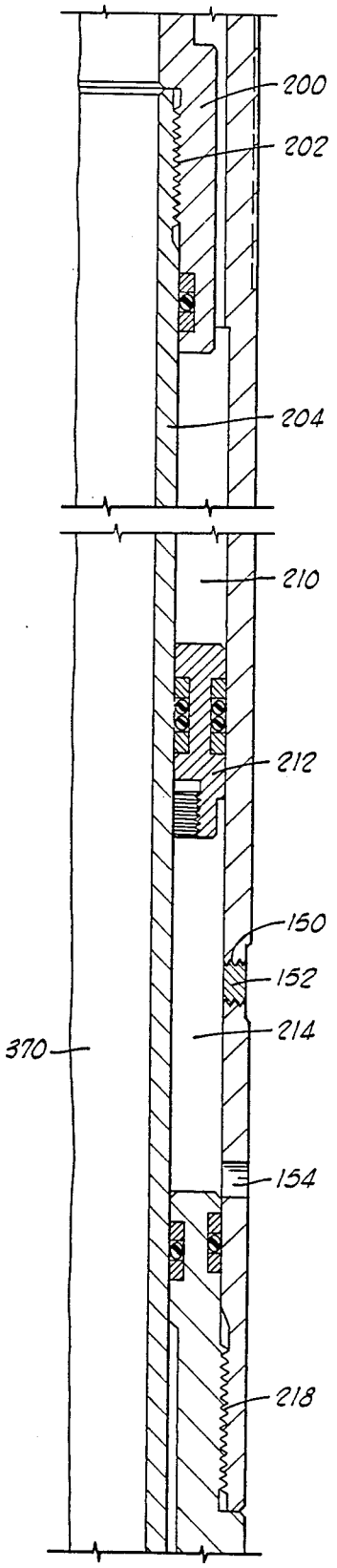
Figure 3E:
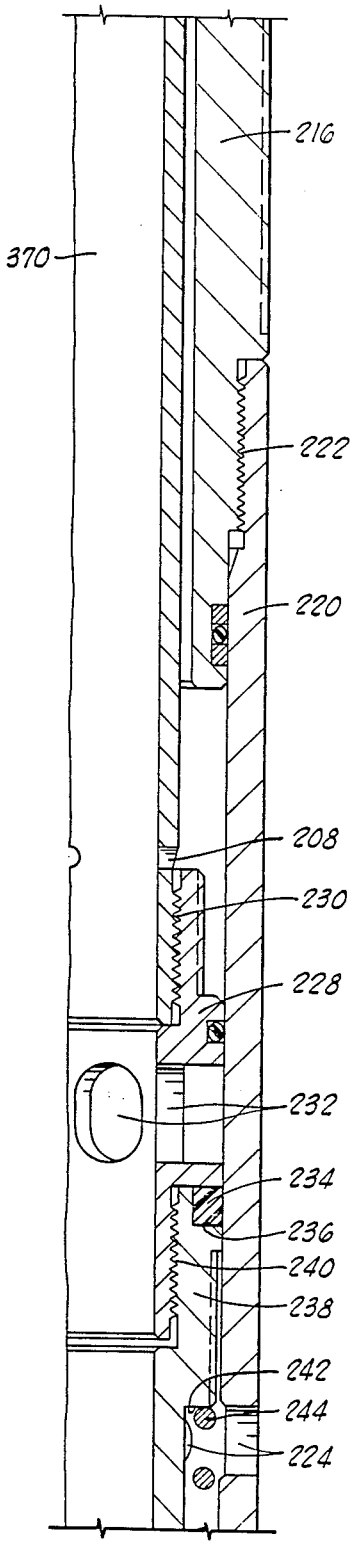
Figure 3F:
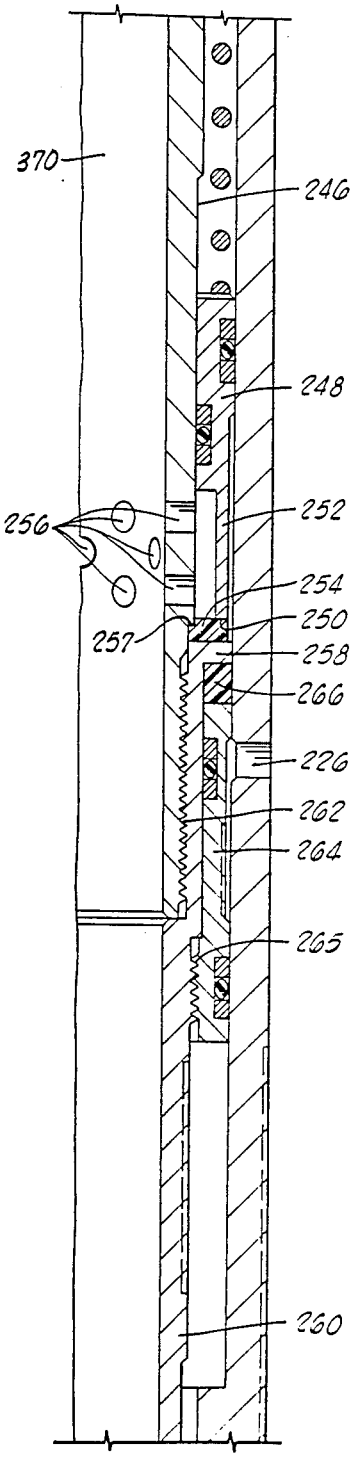
Figure 3G:
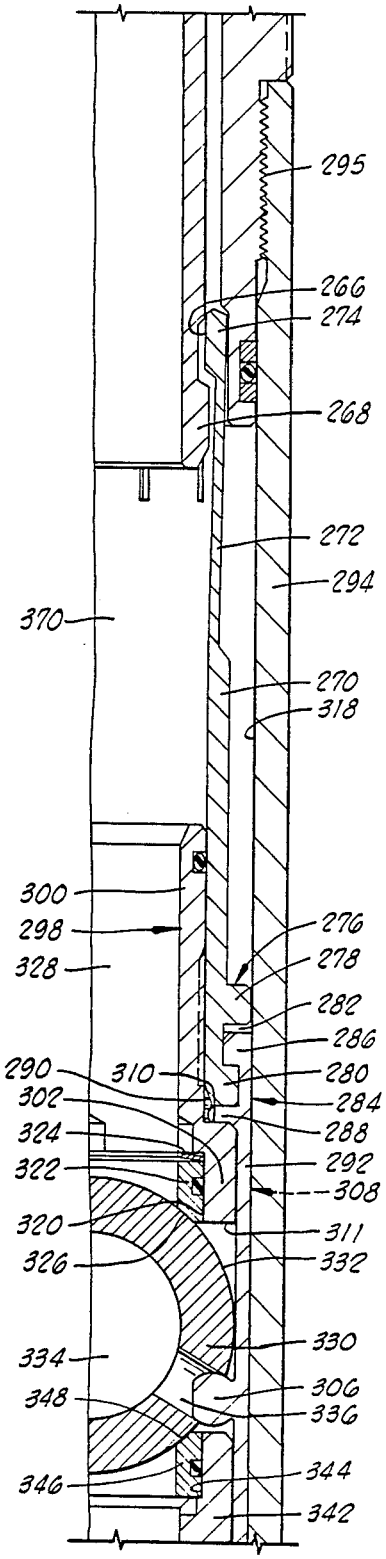
Figure 3H:
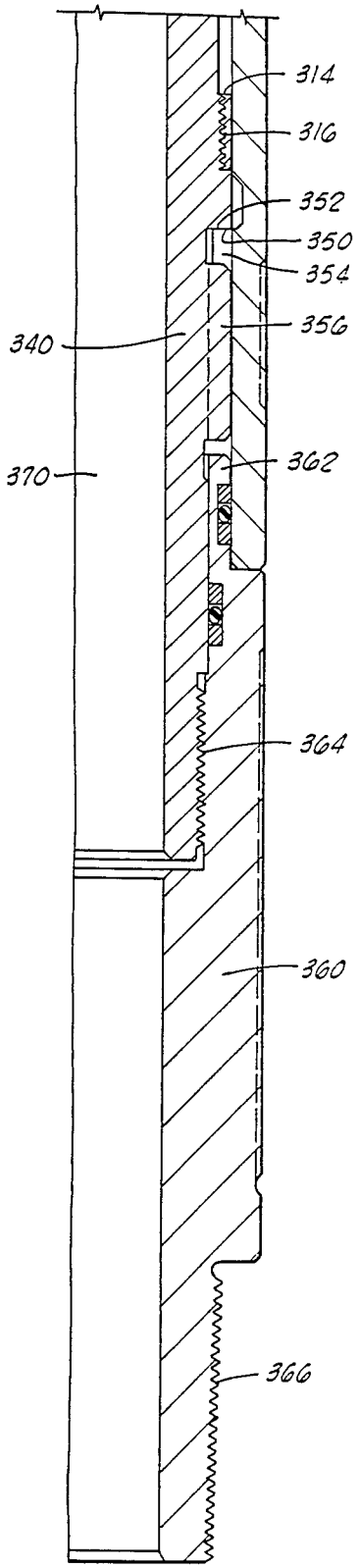
Figure 4A:
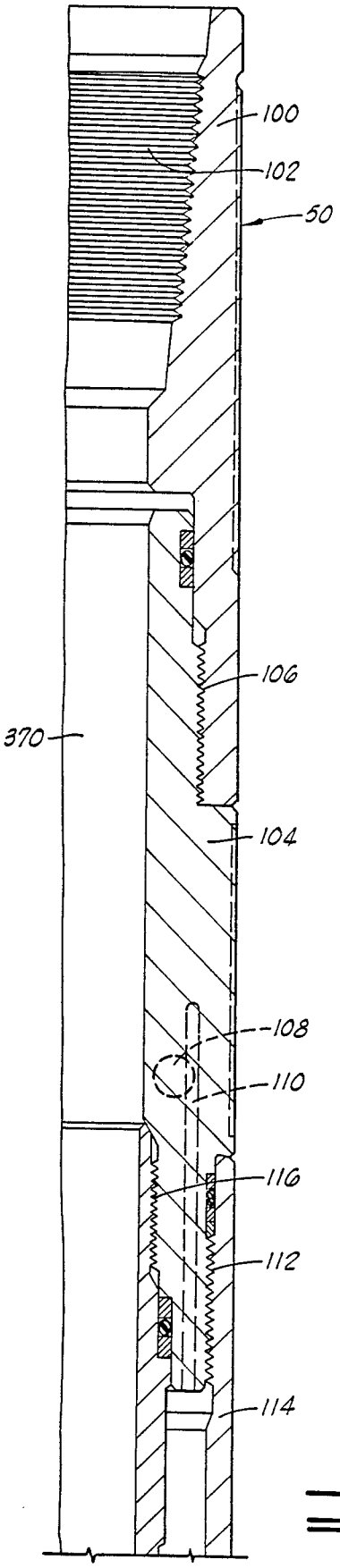
FIGS. 4A–4H comprise a vertical half-section of the tool of the present invention in a nitrogen displacement mode.
Figure 4B:
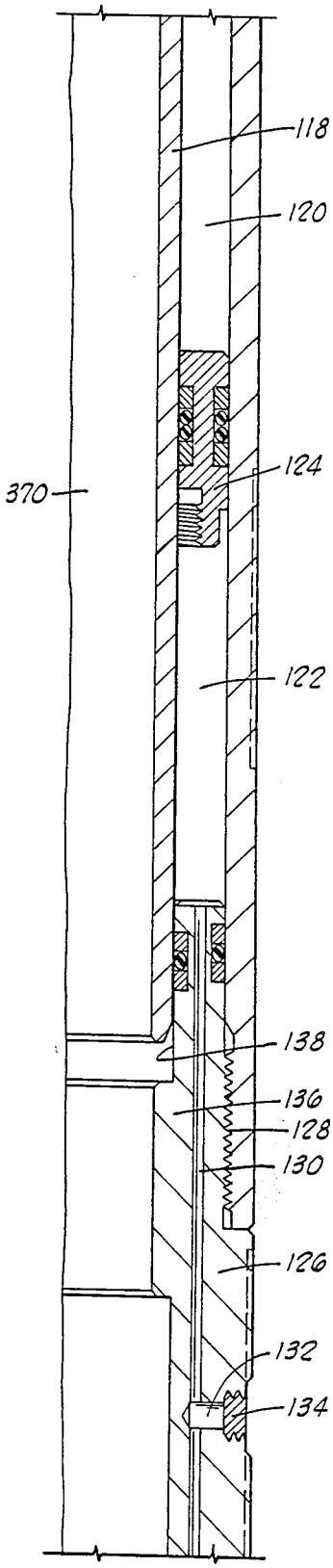
Figure 4C:
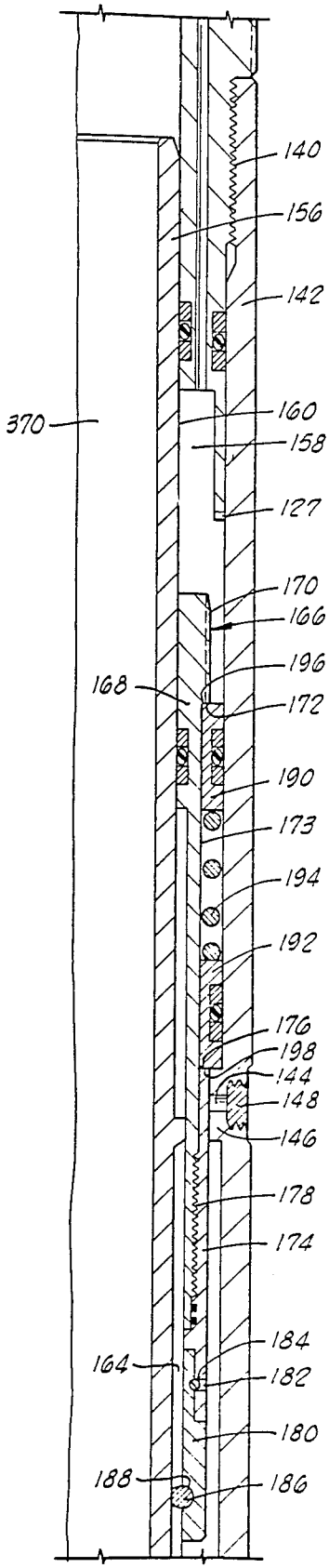
Figure 4D:
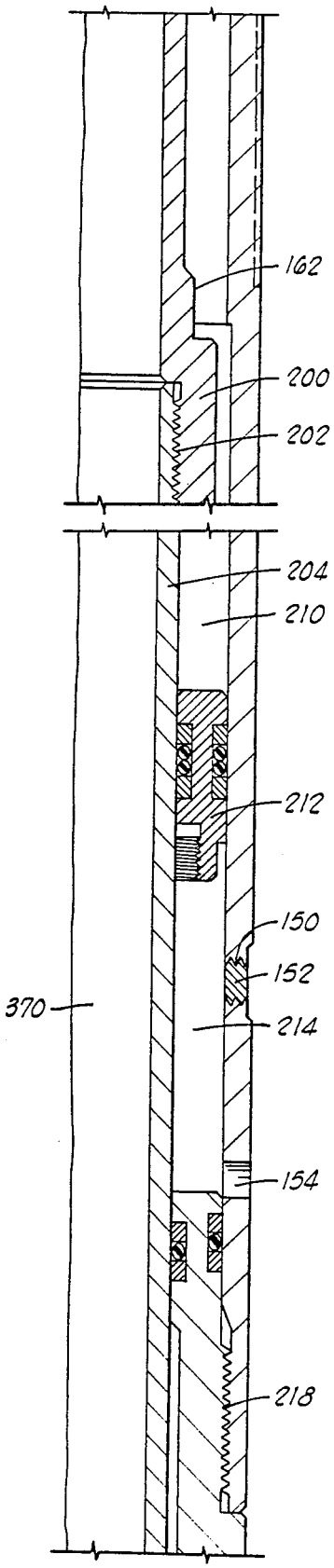
Figure 4E:
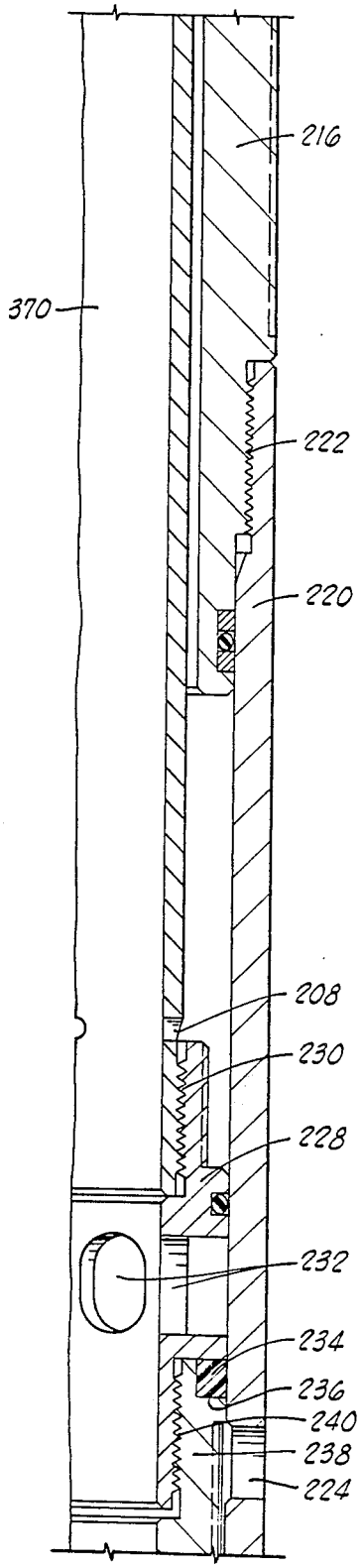
Figure 4F:
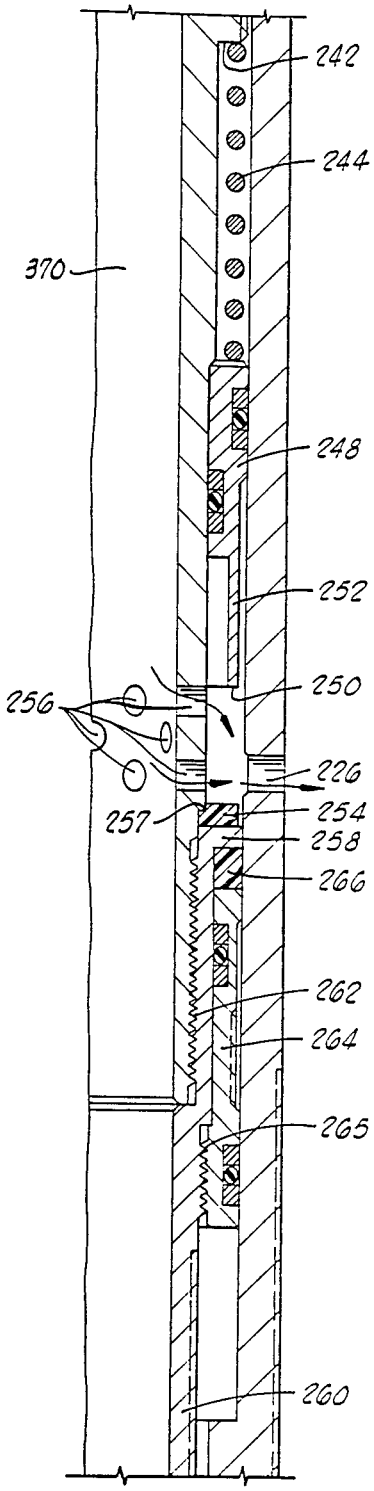
Figure 4G:
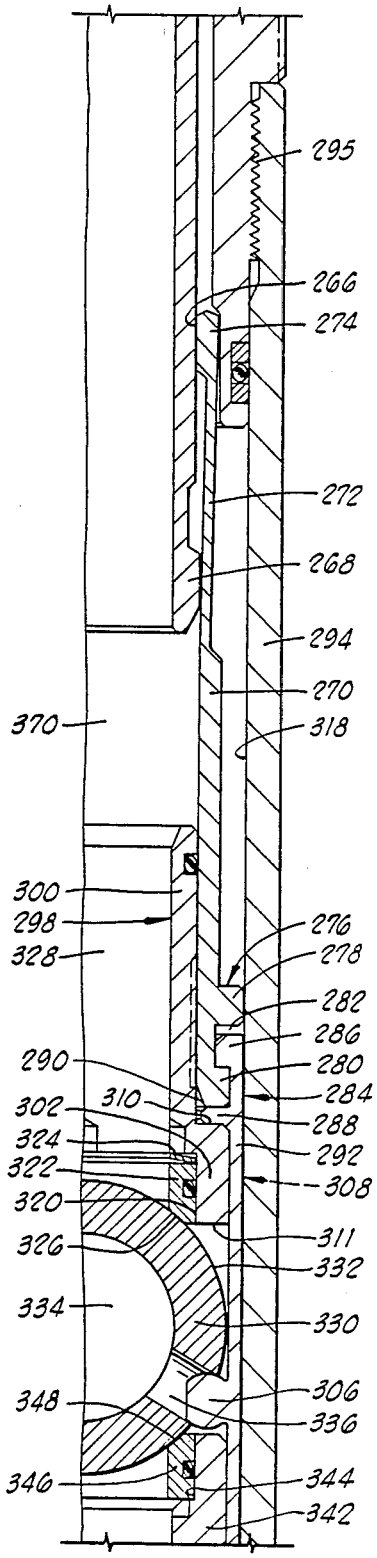
Figure 4H:
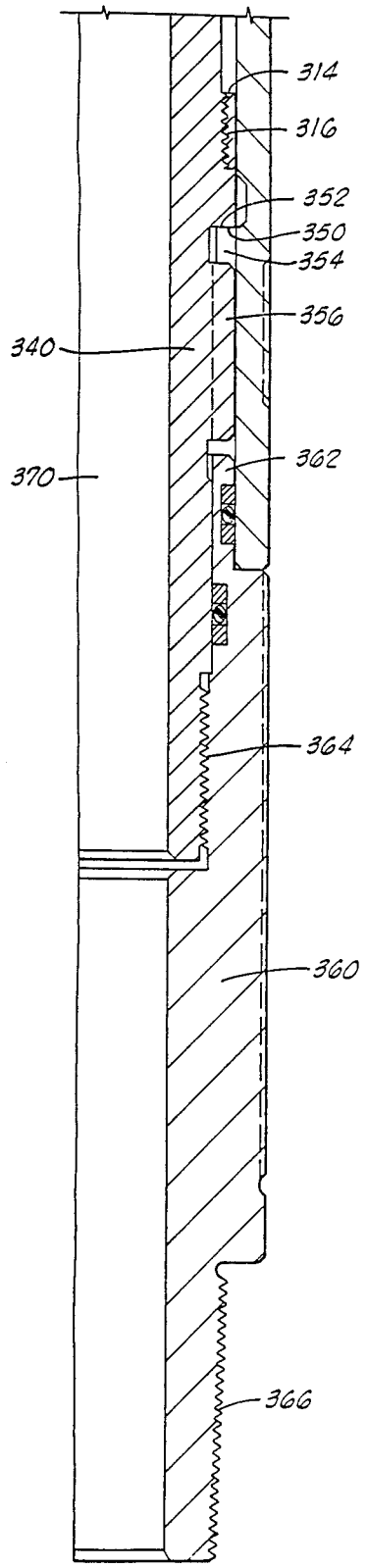
Figure 5A:
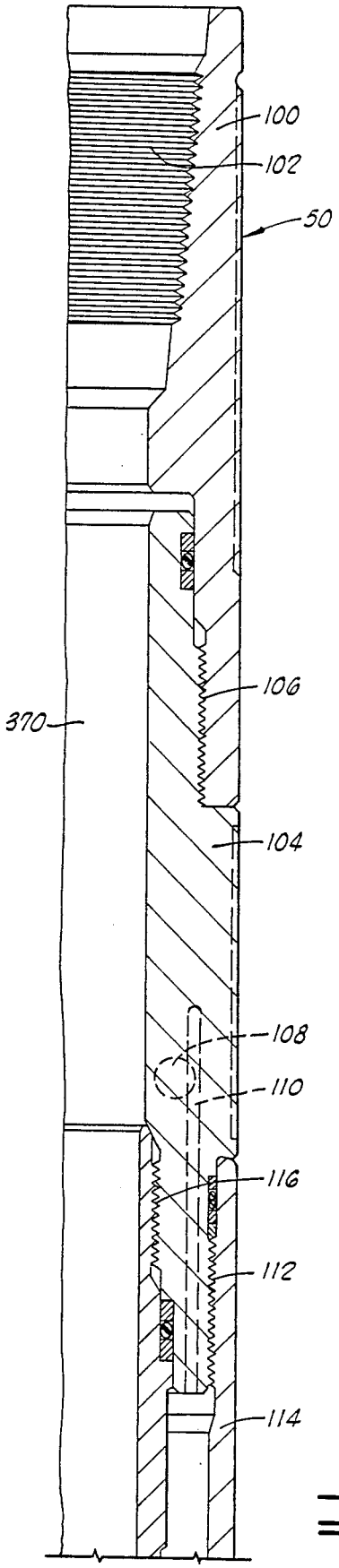
FIGS. 5A–5H comprise a vertical half-section of the tool of the present invention in a circulating mode.
Figure 5B:
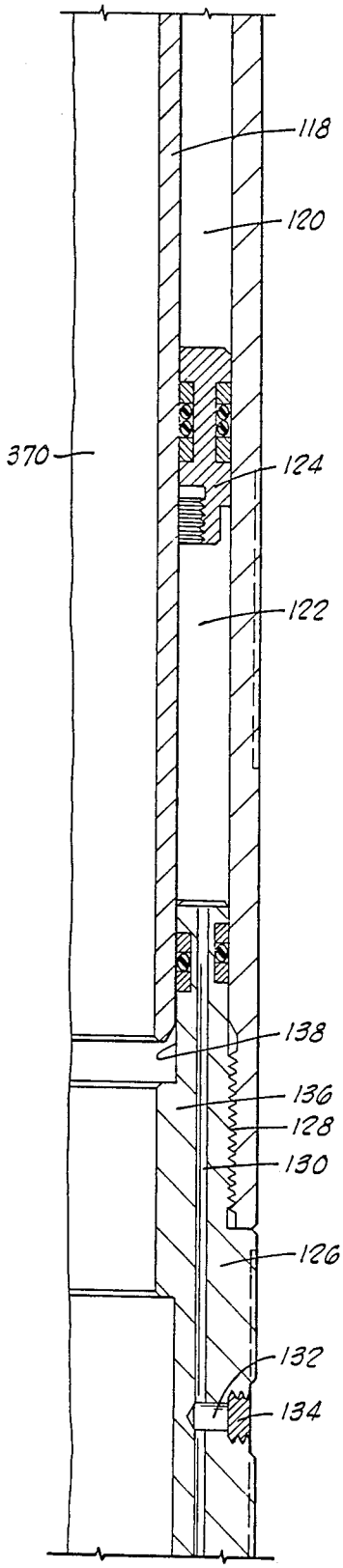
Figure 5C:
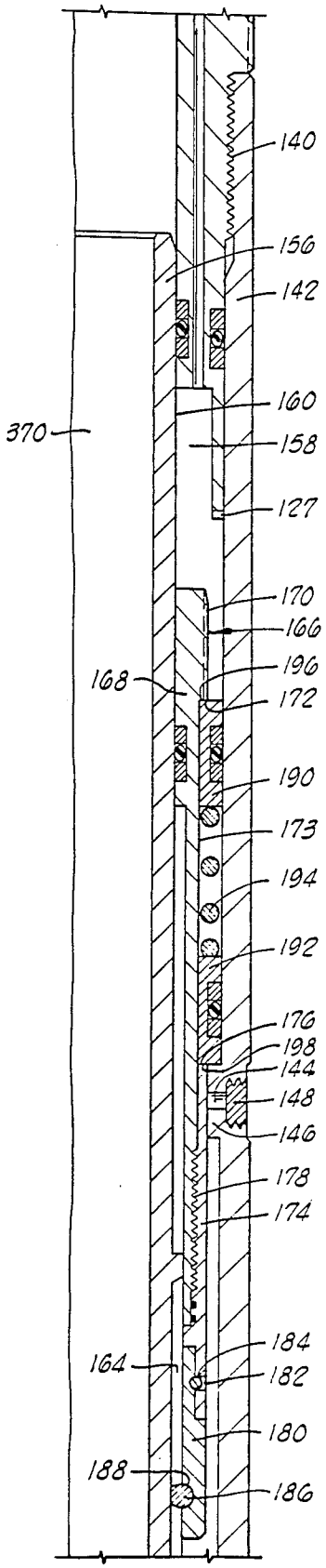
Figure 5D:
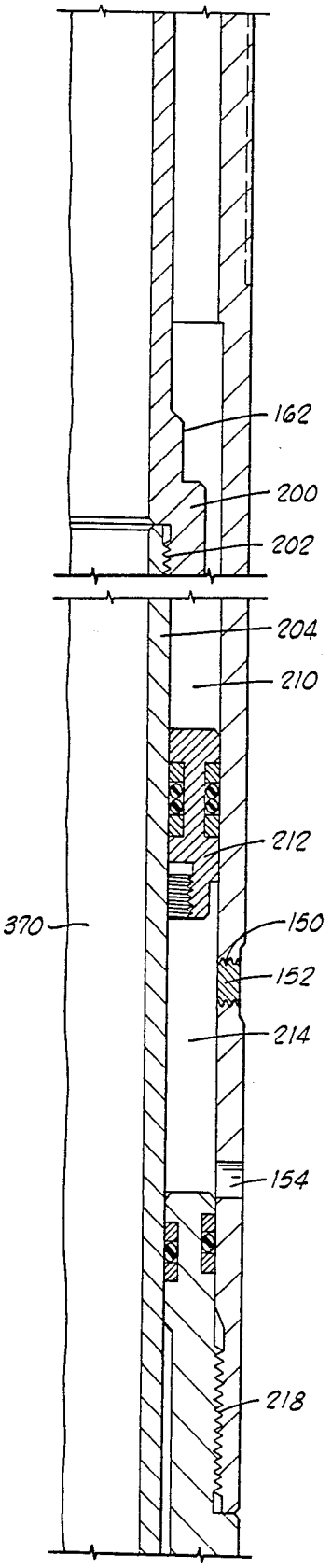
Figure 5E:
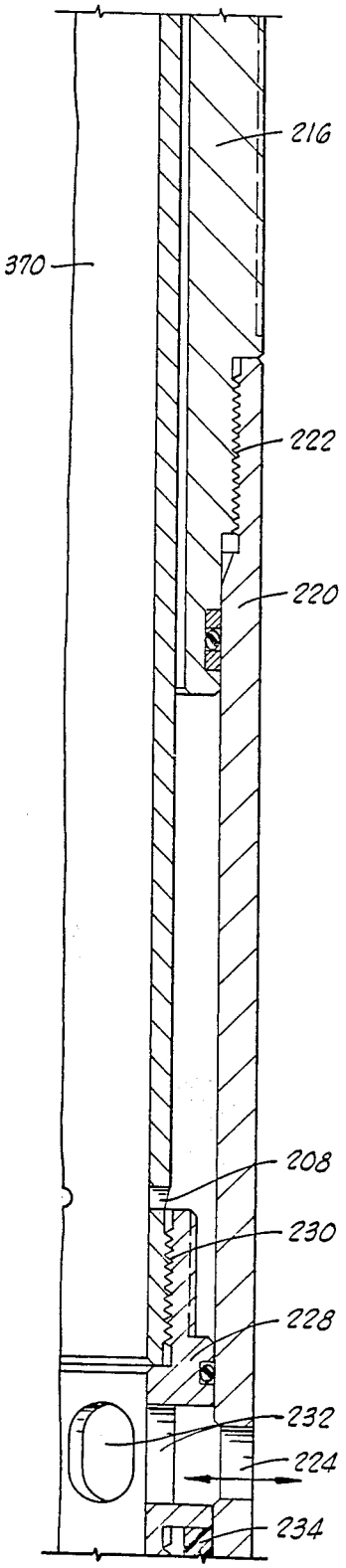
Figure 5F:
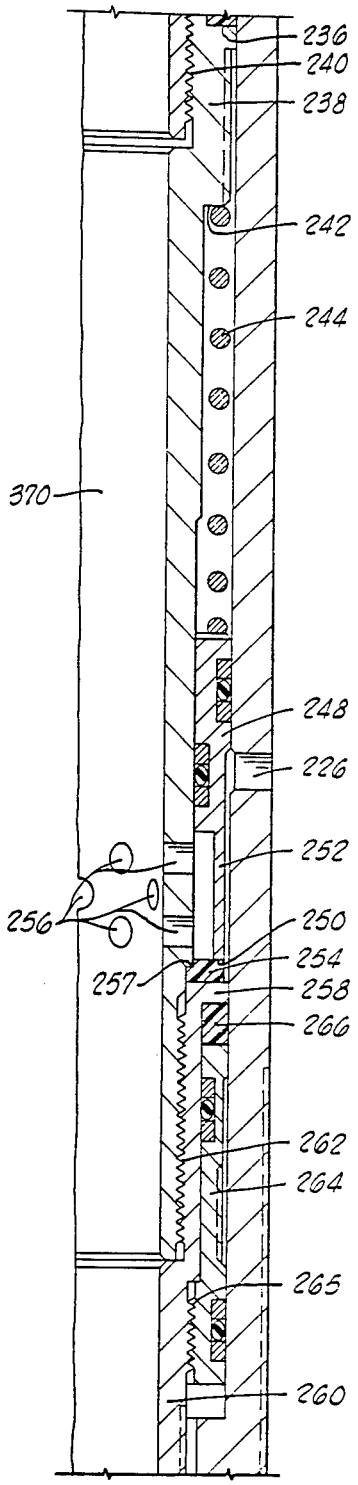
Figure 5G:
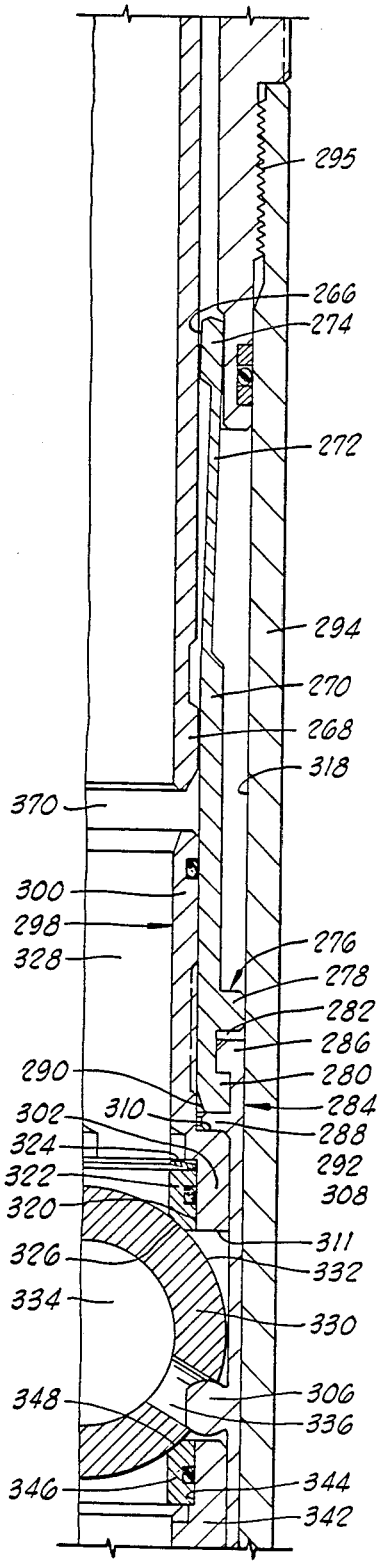
Figure 5H:
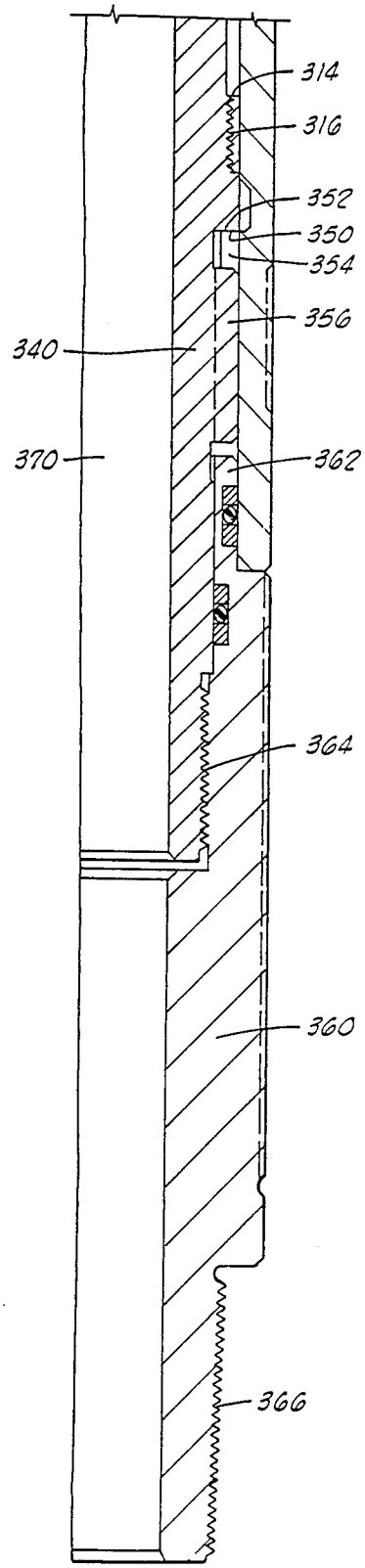
Figure 5:
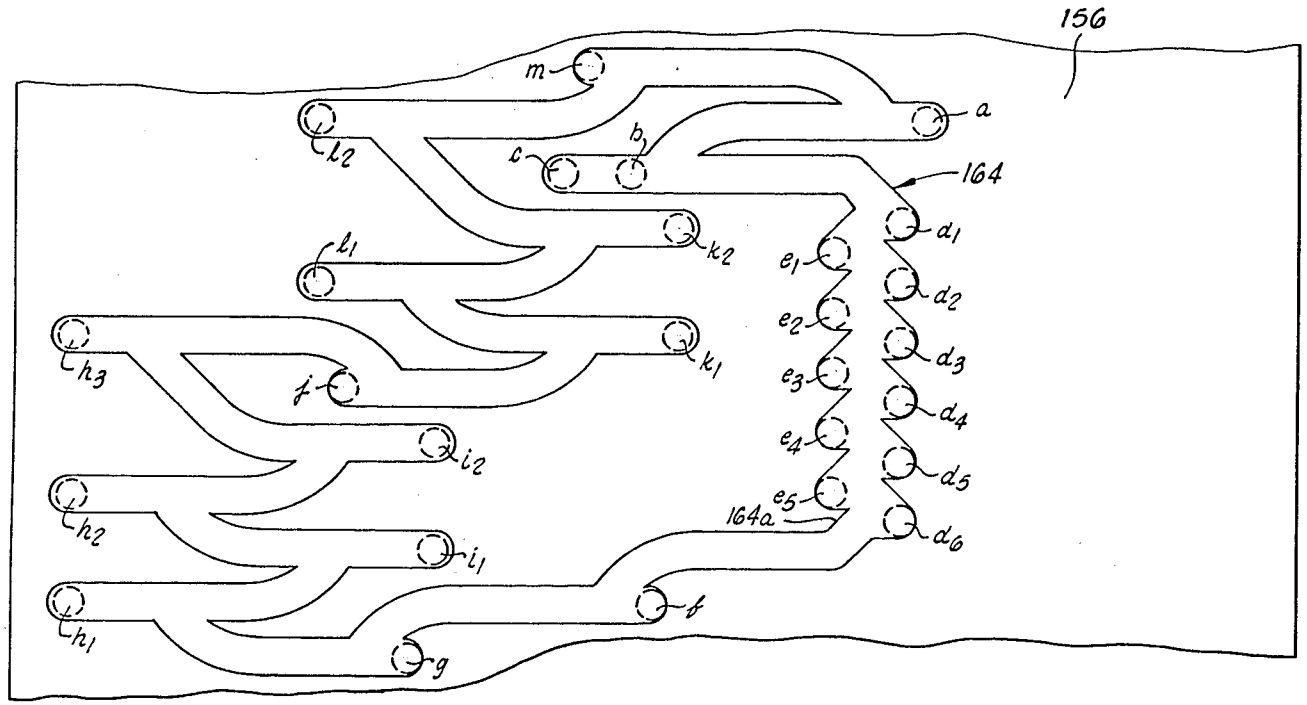

When valve ball 330 is in its open position, as shown in FIG. 2G, a "full open" bore 370 extends throughout tool 50, providing an unimpeded path for formation fluids and/or for perforating guns, wireline instrumentation, etc.

OPERATION OF THE PREFERRED EMBODIMENT OF THE PRESENT INVENTION

Referring to FIGS. 1 through 6, operation of the combination tool 50 of the present invention is described hereafter.

As tool 50 is run into the well in testing string 30, it is normally in its drill pipe tester mode shown in FIGS. 3A–H, with ball 330 in its closed position, with ball bore 334 perpendicular to tool bore 370. In this position, circulation ports 224 are misaligned with circulation apertures 232, seal 234 preventing communication therebetween. In a similar fashion, nitrogen displacement ports 226 are offset from displacement apertures 256 and isolated therefrom by seal 266. With respect to FIG. 6, balls 186 will be in positions "a" in slots 164 as tool 50 is run into the well bore.

As tool 50 travels down to the level of the formation 8 to be tested, at which position packer 44 is set, floating piston 212 moves upward under hydrostatic pressure, pushing ball sleeve assembly 166 upward, and causing balls 186 to move to positions "b", which does not change tool modes or open any valves. A pressure integrity check of the testing string 30 above tool 50 may then be conducted before flow testing the formation.

In order to open valve ball 330 to conduct a flow test of a formation, pressure is increased in annulus 46 by pump 24 via control conduit 26. This increase in pressure is transmitted through pressure ports 154 into well fluid chamber 214, where it acts upon floating piston 212. Piston 212 in turn acts upon a fluid, such as silicone oil, in lower oil chamber 210, which communicates with ratchet chamber 158. In ratchet chamber 158, the pressurized oil pushes against upper ratchet piston 190, the oil being prevented from bypassing piston 190 by the metal to metal seal of sealing surface 196 on piston seat 172. Piston 190 therefore pushes against shoulder 170 on upper sleeve 168, which in turn pulls lower sleeve 174, ball sleeve 180 and balls 186 upward in slots 164. In this manner, balls 186 are moved to positions c, which has no effect on tool operation as balls 186 do not shoulder on the ends of slots 186 in this position. The aforesaid feature is advantageous in that it permits pressuring of the well bore annulus 46 to test the seal of packer 44 across the well bore 4 without opening valve ball 330.

By way of elaboration, when piston 190 reaches overshot 127, it is restrained from further upward movement, but fluid continues to act on shoulder 170 of upper sleeve 168, spreading piston seat 172 from seating surface 196, breaking the seal and dumping fluid past upper sleeve 168 into oil channels 130 and upper oil chamber 122, which equalizes the pressures on both sides of piston 190 and stops the movement of ball sleeve assembly 166 and of balls 186 in slots 164. As the length of the slot is greater than the travel of the ball sleeve assembly, balls 186 stop short of the slot end. As annulus pressure is bled off, the pressurized nitrogen in chamber 120 pushes against floating piston 124, which pressure is transmitted through upper oil chamber 122, channels 130 and ratchet chamber 158 against lower ratchet piston 176. As ratchet piston 176 is biased against piston seat 176, a metal to metal seal is effected between radial sealing surface 198 and seat 176. Ball sleeve assembly 166 is therefore biased downwardly, ratchet balls 186 following the paths of slots 164 to position $d_1$, where they shoulder on the ends of the slots. Tool 50 is now in its formation tester valve mode as shown in FIGS. 2A–2H, but with valve ball 330 closed. When lower ratchet piston 192 reaches annular shoulder 146 in its downward travel, fluid continues to act on ball sleeve assembly 166, spreading sealing surface 198 from seat 176. Fluid is thus dumped below ball sleeve assembly 166 and is thereby equalized, stopping the travel of ball sleeve assembly 166, balls 186 and ratchet mandrel 156.

When the well bore annulus is again pressured, ball sleeve assembly 166 moves upward and balls 186 shoulder in slots 164 at position $e_1$ moving ratchet mandrel 156 upward, which pulls extension mandrel 204, circulation valve sleeve 228, displacement valve sleeve 238 and operating mandrel 260 upward. Operating mandrel 260 pulls collet sleeve 270 upward, which pulls arms 292 and rotates valve ball 330, aligning ball bore 334 with tool bore 370, permitting the formation to flow into the testing string 30 above tool 50. Tool 50 is now in the tester valve mode shown in FIGS. 2A–2H with valve ball 330 open. When annulus pressure is released, balls 186 shoulder at position $d_2$, and close valve ball 330, but tool 50 is still in the tester mode of FIGS. 2A–2H. The process of pressuring and releasing pressure may be continued to open and close ball 330 to flow test the formation until balls 186 reach positions $d_6$.

A subsequent increase in annulus pressure will shoulder balls 186 momentarily on inclined edges **164*a* before moving further along slots 164 past positions f but valve ball 330 will not open. When pressure is released again, balls 186 move downward and shoulder in positions f, moving ratchet mandrel 156 downward and tool 50 out of its formation tester mode and back into the nitrogen displacement mode of FIGS. 4A–H. As can readily be seen in FIG. 4H, protuberances 274 on collet sleeve fingers 272 are disengaged from operating mandrel 260 in this mode, preventing rotation and re-opening of ball 330**.

A subsequent increase and decrease of annulus pressure causes balls 186 to climb further in slots 164 past positions g, and then to push ratchet mandrel 156 downward, moving tool 50 to its circulation valve mode shown in FIGS. 5A–H. Fluid may be circulated into the testing string 30 from annulus 46 through circulation ports 224, which are aligned with circulation apertures 232, ball valve 330 in its closed position and nitrogen displacement ports 224 offset from apertures 256. Fluid may also be circulated into annulus 46 from the testing string 30, as when it is desired to spot formation treatment chemicals into the string prior to an acidizing or fracturing operation. As may be easily observed in FIG. 5G, operating mandrel 156 has continued to travel downward within collet sleeve 270 but out of engagement with protuberances 274.

Subsequent pressure increases and decreases in the annulus will move balls 186 sequentially to positions $h_1$, $i_1$, $h_2$, $i_2$, and $h_3$ without changing tool 50 from its circulation mode, as balls 186 do not shoulder in slots 164. This provides a margin of safety against changing of tool modes due to inadvertent pressure cycling in the annulus during circulation.

As annulus pressure is decreased after balls 186 reach positions $h_3$, they will move downward past positions j, whereupon a subsequent annulus pressure increase will shoulder balls 186 in positions j, moving ratchet mandrel 156 upward and tool 50 back into its nitrogen displacement mode of FIGS. 4A–H. If treatment chemicals have not been spotted in the string, and if it is desired to displace fluid out of the testing string 30 prior to a further test, as where the formation has not flowed initially due to hydrostatic head of fluid in the string, nitrogen may be introduced into the testing string 30 under pressure. In this mode, valve ball 330 is closed and circulation ports 224 offset from apertures 232, but nitrogen displacement ports 226 are aligned with apertures 256. The pressurized nitrogen will act upon displacement piston 248, moving it away from seat 254, and permit fluid in the string to exit into the well bore annulus. When pressure is reduced in the string, annulus pressure outside tool 50 will act upon the upper end of displacement piston 248 through circulation ports 224, and firmly press valve surface 250 against seat 254, preventing re-entry of fluid into the string.

As in the circulation mode, several subsequent increases and decreases in annulus pressure will move balls 186 in slots 164, but will not change the mode of tool 50. As pressure is decreased and increased sequentially when balls are in positions j, they move to positions $k_1$, $l_1$, $k_2$ and $l_2$. When pressure is again decreased with balls 186 in position $l_2$, they will move downward in slots 164 past position m, where a subsequent increase will shoulder balls 186 out on slots 164 in positions m, changing tool mode to the drill pipe tester mode of FIGS. 3A–H, offsetting nitrogen displacement ports and apertures, leaving circulation ports and apertures offset, and leaving valve ball 330 closed. A further decrease in pressure will return balls 186 to positions a, and the operator may begin another cycle of tool 50, such as to treat the formation and retest it after the treatment, or test it with the string unloaded of fluid.

By way of further explanation of the mode changing and operating sequence of tool 50, the reader should note that the tool only changes mode when balls 186 shoulder at specific foreshortened positions on slot 164 during cycling of the tool. For example, tool 50 changes mode at positions $d_1$, $d_6$, f, g, j and m. Four mode changes are effected by annulus pressure decrease, and two by an increase. The pressure increases which shoulder balls 186 in positions $e_1$ through $e_5$ do not produce a mode change because balls 186 travel within a restricted longitudinal range limited by the dumping of the operating fluid in the tool by pistons 190 and 192, and the configuration of the slots 164 from positions $e_1$ through $e_5$ does not permit balls 186 to climb in slots 164 to change tool modes.

OPERATION OF A SECOND PREFERRED EMBODIMENT OF THE PRESENT INVENTION

As has previously been noted, tool 50 of the present invention may be changed to operate in a three-mode sequence as a drill pipe tester, circulation valve and nitrogen displacement valve in conjunction with a separate tester valve therebelow in the string by merely removing ratchet mandrel 156 and inserting another mandrel 156' having a different slot program 164' therein. Such a mandrel slot program 164' is shown in FIG. 8. In all respects other than substitution of mandrel 156' for mandrel 156, tool 50 remains structurally the same even though its modes of operation have been altered.

With slot 164', tool 50 is run into the well bore in its drill pipe tester mode with balls 186 in positions a as shown in FIG. 8 and tool 50 in the mode shown in FIGS. 3A–H. As tool 50 travels down the well bore, hydrostatic annulus pressure will move balls 186 to position b. As valve ball 330 remains closed, an integrity test of the drill pipe may be conducted. The first increase in annulus pressure subsequent to the drill pipe test will move balls 186 to positions c, which will not change tool mode, and a subsequent decrease and increase will shoulder balls on slot 164' at position d, which will rotate valve ball 330 to an open position, aligning bore 334 with tool bore 370 as shown in FIGS. 2A–2H. This same pressure increase will have opened the ball of the tester valve therebelow, which may be a valve such as are disclosed in U.S. Pat. Nos. 3,964,544, 3,976,136, 4,422,506, 4,429,748, as well as others known in the art. The formation then flows through the tester valve and tool 50 during the test. When annulus pressure is decreased to close the tester valve, the decrease will move balls 186 to positions $e_1$, which will not close valve ball 330 because balls 186 do not shoulder on slots 164'. Subsequent pressure increases and decreases to flow test the well via the tester valve will move balls 186 sequentially to positions $f_1$, $e_2$, $f_2$, $e_3$, $f_3$ and $e_4$, during which valve ball 330 of tool 50 will remain open. During the next subsequent annulus pressure increase when in position $e_4$, balls 186 will climb in slot 164' past positions g, valve ball 330 remaining open. When annulus pressure is relieved, however, balls 186 will shoulder in positions g and move ratchet mandrel 156' downward, closing valve ball 330 and returning tool 50 to its drill pipe tester mode shown in FIGS. 3A–H.

Another increase and decrease in annulus pressure will move balls 186 to shoulder in positions h, changing tool to the nitrogen displacement mode of FIGS. 4A–H. A second increase/decrease pressure cycle will move balls 186 to positions i and tool 50 to the circulation mode of FIGS. 5A–5H

Subsequent increases and decreases in annulus pressure will ratchet balls 186 through positions $j_1$, $i_2$, $j_2$, $i_3$, $j_3$, and down past $k_1$ without changing tool mode, after which an increase will shoulder balls 186 in positions $k_1$, changing tool 50 to the nitrogen displacement mode of FIGS. 4A–4H.

Further annulus pressure cycling in decrease/increase sequence will move balls 186 to positions $l_1$, $k_2$, $l_2$, $k_3$ and down past positions m without changing tool mode.

A subsequent pressure increase will shoulder balls 186 in positions m and change tool 50 to its drill pipe tester mode of FIGS. 3A–H. Further pressure cycling of the annulus will begin another tool cycle.

As noted with respect to slot 164, tool 50 only changes mode when balls 186 shoulder in foreshortened paths in the slot. In slot 164' for example, tool mode changes only in ball positions d, g, h, $i_1$, $k_1$, and m. In all other instances, balls 186 merely travel slots 164' with no effect on tool operation.

ALTERNATIVE EMBODIMENTS OF THE PRESENT INVENTION

Figure 9:
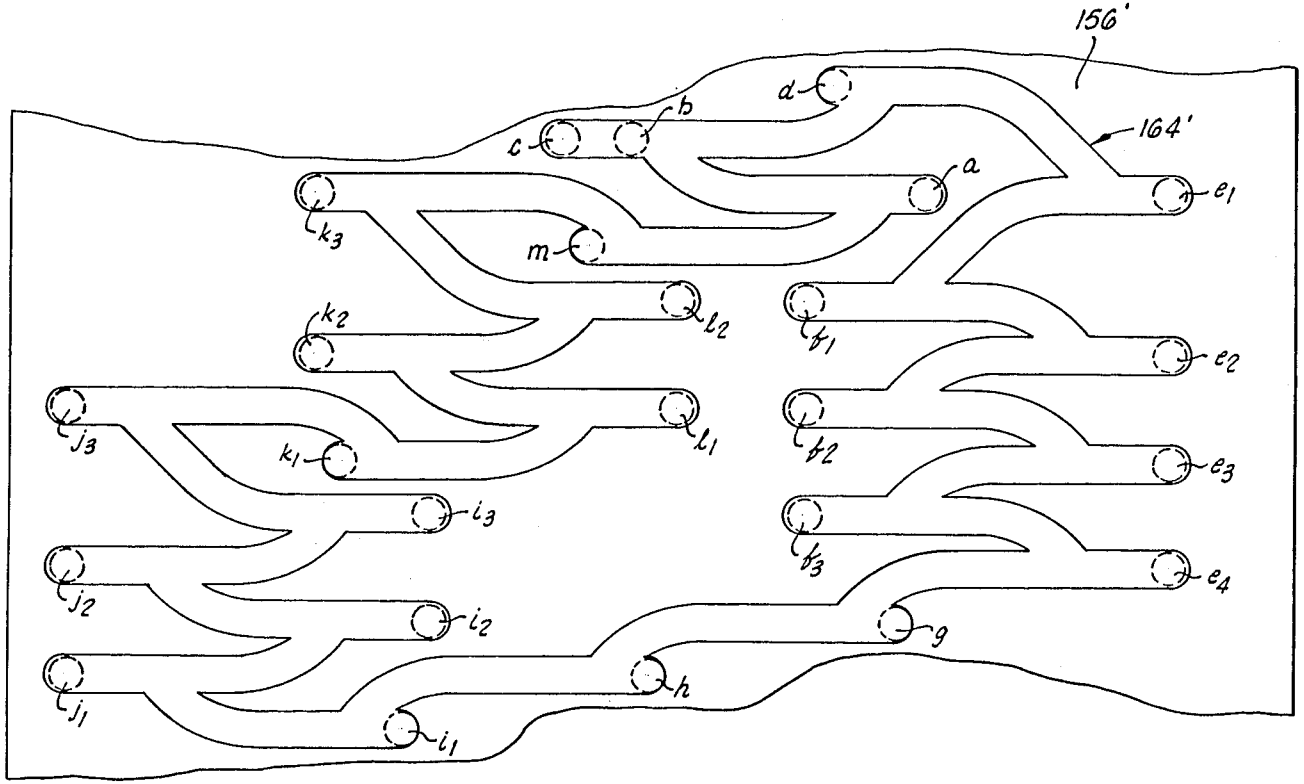
Figure 9:
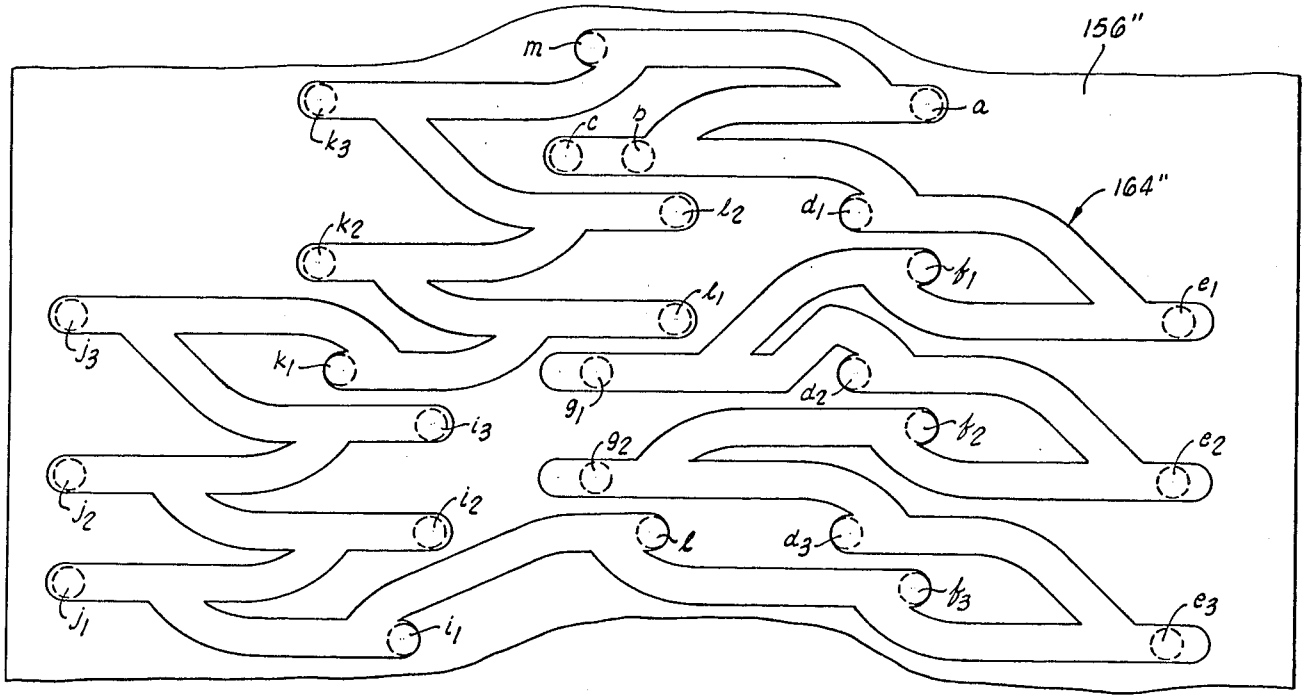

It is also possible to re-program tool 50 of the present invention to effect modes of operation other than those disclosed with respect to the first and second preferred embodiments For example, referring to FIG. 9, the program of slot 164" is shown. Using mandrel 156" with slot 164", tool 50 is run into the well bore in its drill pipe tester mode of FIGS. 3A–3H, with balls 186 in positions a in slots 164. Going downhole, balls 186 will be forced upward to positions b by hydrostatic pressure in the annulus. A drill pipe integrity test may be conducted when tool 50 reaches the test level in the well bore.

After the packer is set, the formation may be flow tested by raising annulus pressure, lowering it and raising it again, which moves balls up through portions c, down past portions $d_1$, and up to $d_1$ whereat balls 186 shoulder and open valve ball 330, tool 50 being in the tester valve mode of FIGS. 2A–H. A subsequent decrease in annulus pressure will move balls 186 to position $e_1$, which will retain valve ball 330 in an open position. Another increase/decrease cycle will close valve ball 330 due to shouldering of balls 186 in positions $f_1$ and downward movement of ratchet mandrel 156. Another increase/decrease cycle will result in ball movement to positions $g_1$, and down past $d_2$, with valve ball 330 remaining closed. The next increase/decrease opens valve ball 330 when balls 186 shoulder in positions $d_2$, and leave valve ball 330 open when balls 186 travel to positions $e_2$. The following increase/decrease shoulders balls 186 in positions $f_2$ as annulus pressure is relieved, closing valve ball 330. A further increase/decrease moves balls 286 to position $g_2$ and back down below $d_3$, after which the next subsequent increase/decrease shoulders balls 186 in positions $d_3$, opening valve ball 330 and leaving it open as balls 186 land at position $e_3$.

To continue the tool cycle, an annulus pressure increase/decrease moves balls 186 to $f_3$, closing valve ball 330. Balls 186 climb slots 164''' with the next increase/decrease to position h, whereat tool 50 is shifted to its nitrogen displacement mode of FIGS. 4A–H, and then to its circulation mode of FIGS. 5A–H when annulus pressure is again cycled and balls 186 shoulder in positions $i_1$.

The next three increase/decrease cycles in annulus pressure will move balls 186 through positions $j_1$, $i_2$, $j_2$, $i_3$, $j_3$ and back down past position $k_1$. During this travel, balls 186 do not shoulder, and the tool 50 does not change mode. However, the next subsequent increase in pressure will shoulder balls 186 in positions $k_1$, change tool mode to the nitrogen displacement mode of FIGS. 4A–H.

The next two decrease/increase pressure cycles move balls 186 through positions $l_1$, $k_2$, $l_2$ and $k_3$ without change in tool mode. During the following decrease/increase cycle, however the tool is moved back to its drill pipe test mode of FIGS. 3A–H when balls 181 move downward below positions on the decrease and then shoulder as pressure is increased. When annulus pressure is next decreased, balls 186 move back to positions a for commencement of a new tool cycle.

As was noted with respect to the previous operating mandrels 156 and 156' mandrel 156'' does not move longitudinally to operate valve ball 330 and to change tool modes unless balls 186 shoulder in foreshortened legs of slots 164''. In slots 164'', only positions $d_1$, $f_3$, h, $i_1$, $k_1$, and m produce a change of mode. Positions $d_1$, $f_1$, $d_2$, $f_2$, $d_3$ and $f_3$, however, all serve to open and close, respectively valve ball 330.

With the slot program employed in slot 164'', the test operator must positively pressure the annulus and then relieve pressure for valve ball 330 to move from a closed to an open position and vice-versa, which feature prevents a shutoff in the middle of a flow test if annulus pressure is reduced inadvertently. Furthermore, valve ball 330 may be left open after the formation test and circulation, to let testing string 30 drain of fluid as it is removed from well bore 4.

Figure 10:
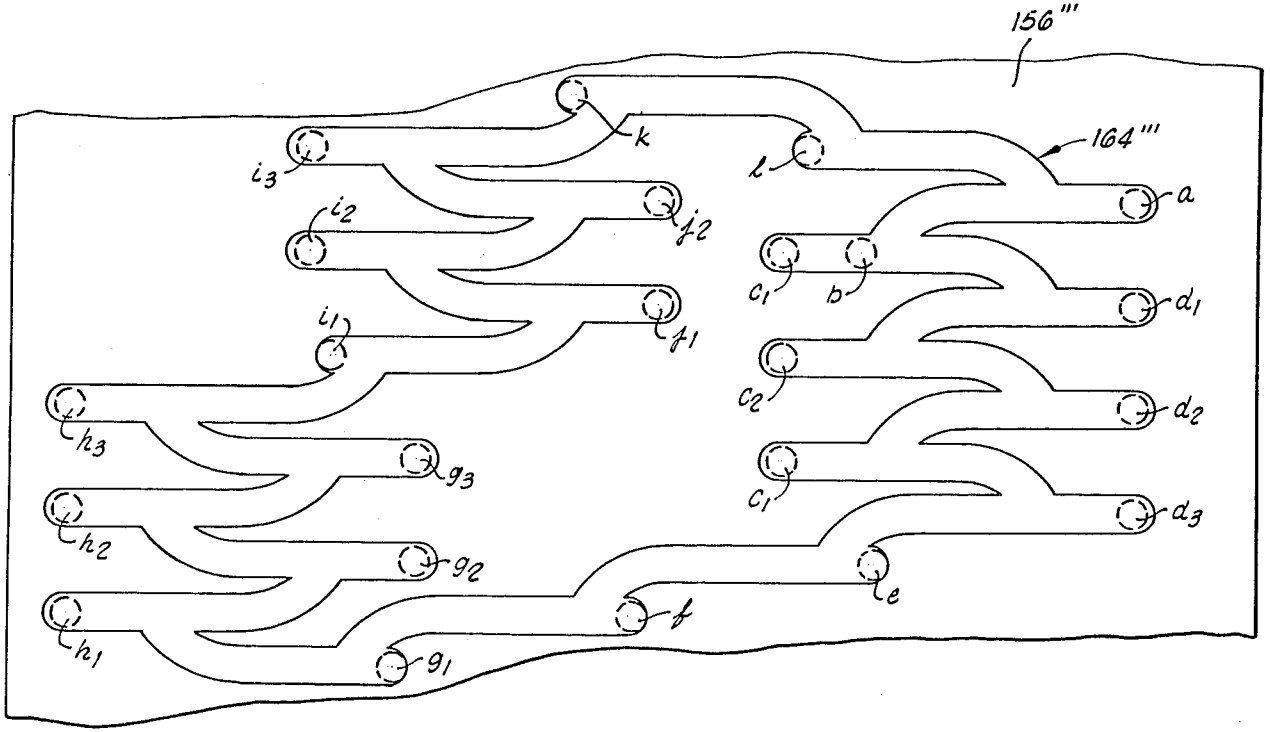

Another embodiment of the present invention may be effected utilizing yet another slot program, illustrated in FIG. 10 as slot 164''' on mandrel 156'''. With slots 164''', tool 50 is restricted to a two-mode operation, circulation valve, which would be preferred in some areas of the world which do not conduct drill pipe tests prior to flow testing the well, and which use a separate tester valve below tool 50.

With slots 164''', ratchet balls 186 commence in positions a, and move to be as tool 50 travels down the well bore. Valve ball 330 is open. A first annulus pressure increase after packer 44 is set will result in ball movement to positions $c_1$, and subsequent decrease/increase cycling will move balls 186 through positions $d_1$, $c_2$, $d_2$ and $c_3$ to $d_3$. The next three increase/decrease pressure cycles will result in balls 186 climbing slots 164''' to positions e, which closes valve ball 330; positions f, which places tool 50 in its displacement valve made; and position $g_1$, which places tool 50 in its circulation valve mode. The next three increase/decrease pressure cycles will result in free ball movement through positions $h_1$, $g_2$, $h_2$, $g_3$ and $h_3$ past $i_1$, without moving tool 50 from its circulation valve mode. However, a subsequent increase will change tool mode to displacement valve, as balls 186 shoulder in positions $i_1$. This mode is maintained through the next two decrease/increase cycles with free ball travel. The next decrease/increase cycle then moves balls 186 to shoulder in positions k, which offsets both displacement ports 226 from displacement apertures 256 and circulation ports 224 from circulation apertures 232 while leaving valve ball 330 closed. The next subsequent decrease/increase cycle will again open valve ball 330 with balls 186 in positions 1, and an annulus pressure decrease will place balls back in positions a for another tool cycle. In slots 164''', balls 186 shoulder in positions e, f, $g_1$, $i_1$, k and 1.

ALTERNATIVE EMBODIMENT OF THE DISPLACEMENT VALVE OF THE PRESENT INVENTION

Figure 7A:
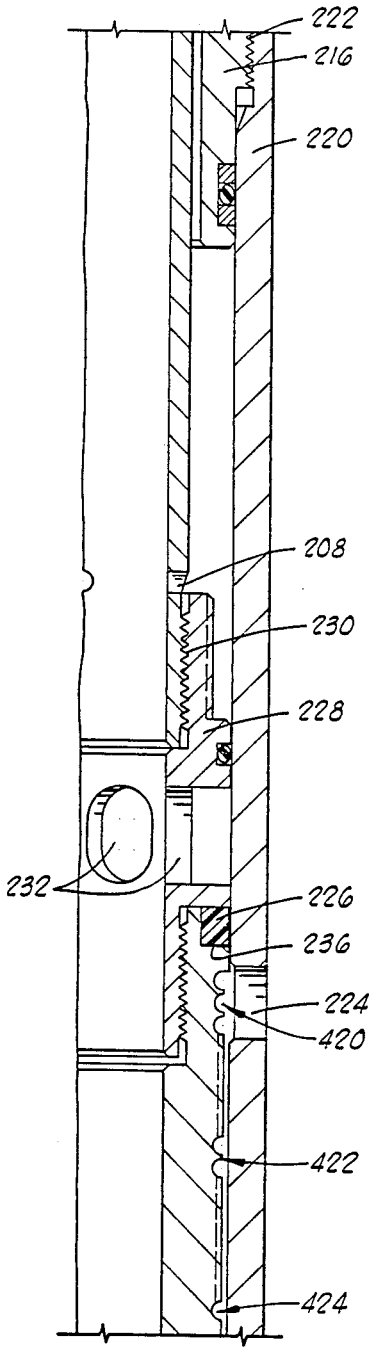
FIGS. 7 and 7B comprise an enlarged section of an alternative embodiment of the nitrogen displacement valve of the present invention.
Figure 7B:
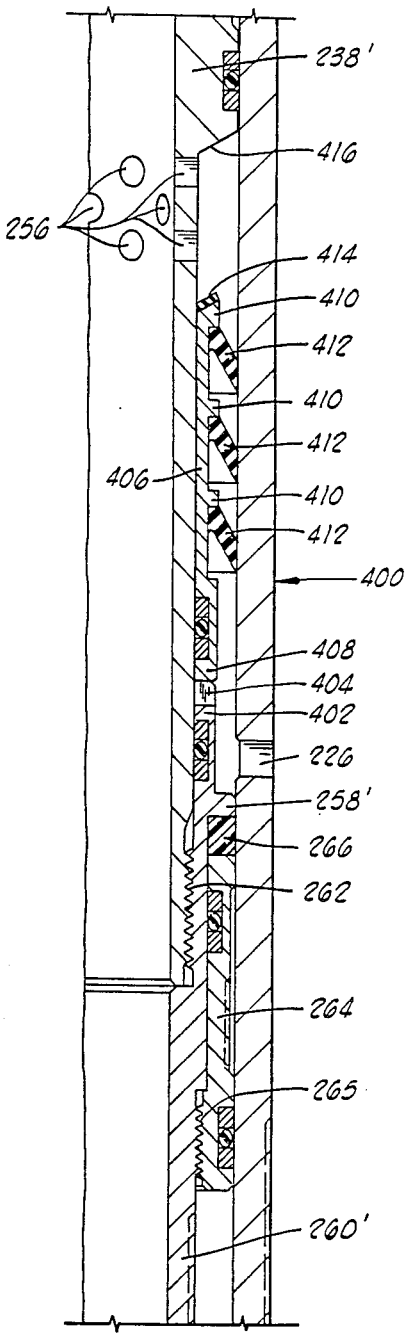

FIGS. 7A and 7B illustrate an alternative construction for a nitrogen displacement valve assembly which may be employed in tool 50. Valve assembly 400 includes an outer circulation-displacement housing 220' with slightly longer spacing between circulation ports 224 and displacement apertures 226 than in standard housing 220. At its upper end, housing 220' is secured at threaded connection 222 to extension case 216, while at its lower end (not shown) it is secured to ball case 294. Within tool 50, extension mandrel 204 is secured at threaded connection 230 to circulation valve sleeve 228, through which circulation apertures 232 extend. Sleeve 228 is threaded to displacement valve sleeve 238', seal 226 being maintained in an annular recess 236 therebetween to isolate circulation apertures 232 from circulation ports 224.

On the exterior of displacement valve sleeve 238' lie annular marker grooves 420 (three grooves), 422 (two grooves) and 424 (one groove), the purpose of which will be explained hereafter. Below the marker grooves displacement apertures 256 extend through the wall of sleeve 238' adjacent obliquely inclined annular wall 416, which is a part of displacement assembly 400.

Flapper mandrel 406 slides on the exterior of sleeve 238' below wall 416, and is restricted in its longitudinal travel by the abutment of elastomeric seal 414 against wall 416 at its upper extent, and by the abutment of shoulder 408 against stop 404 extending upward from shoulder 402 on operating mandrel 260'. Stops 404 prevent pressure locking of shoulder 408 to shoulder 402. Seal 266 is maintained in a recess between annular shoulder 258' on mandrel 260' and seal carrier 264, which surrounds threaded connection 262 between sleeve 238' and operating mandrel 260', and is itself secured to operating mandrel 260' at threaded connection 265.

Flapper mandrel 406 carries thereon a plurality of frustoconical valve flappers 412 thereon, which are bonded to mandrel 406 adjacent annular shoulders 410.

Displacement assembly 400 is placed in its operative mode in the same fashion as the displacement mode of tool 50 in FIGS. 2–5, that is by longitudinally moving the internal assembly connected to ratchet mandrel 156 through the interaction of balls 186 in slots 164. However, unlike displacement piston 248 which is spring-biased toward a closed position against seat 254 (FIGS. 2E-F, 3E-F) and is moved therefrom by nitrogen flowing under pressure through apertures 256 (FIGS. 4E-F), mandrel 406 operates when placed adjacent displacement ports 226 (FIGS. 7A-B) through downward movement against stops 404 followed by collapse of flappers 412 against mandrel 406 to permit exit through ports 226 of the fluid in the string and the pressurized nitrogen impelling it into the well bore annulus.

If pressure is removed from the bore 370 of tool 50, the hydrostatic head (and pressure) in the annulus will expand flappers 412 against circulation-displacement housing 220' and move mandrel 406 upward against wall 416, whereon elastomeric seal 414 will seat, preventing re-entry of annulus fluids into bore 370.

An added feature of assembly 400 is the ease of identification of tool mode through the use of marker grooves 420, 422 and 424. For example, when tool 50 is in its circulation mode, circulation ports 224 will be aligned with circulation apertures 232 and no grooves will be visible. When tool 50 is in its displacement mode (FIGS. 7A-B), grooves 420 will be visible. When valve ball 330 is closed, grooves 422 will be visible, and when valve ball 330 is open, groove 420 will be visible. With knowledge of which ratchet mandrel is employed in tool 50 and the initial portion desired, the tool will then be easily able to ensure placement of tool 50 in its proper mode for running into the well bore.

It is thus apparent that a novel and unobvious multimode testing tool has been developed, which further includes a novel and unobvious operating mechanism and valves therein. It will be readily apparent to one of ordinary skill in the art that numerous additions, deletions and modifications may be made to the invention as disclosed in its preferred and alternative embodiments as disclosed herein. For example, tool 50 might employ an all-oil operating biasing mechanism such as is disclosed in U.S. Pat. Nos. 4,109,724, 4,109,725 and U.S. applications Ser. Nos. 354,529 and 417,947; the nitrogen displacement valve might be placed above the circulation valve in the tool; alternative pressure-responsive check valve designs might be employed as displacement valves; Belleville or other springs might be substituted for the coil springs shown in tool 50; the operating mechanism of the tool, including nitrogen and/or oil chambers, the ratchet mandrel and the ball sleeve assembly could be placed at the bottom of the tool or between the ends thereof; the ratchet balls could be seated in recesses on a mandrel and a rotating ratchet sleeve with slots cut on the interior thereof might be employed therearound and joined by swivel means to a sleeve assembly carrying annular pistons 190 and 192 thereon; a ratchet sleeve might be rotatably mounted about a separate mandrel and ratchet balls mounted in a non-rotating sleeve assembly thereabout; a sleeve-type valve such as is disclosed in U.S. Pat. No. RE 29,562 might be utilized to close bore 370 through tool 50 in lieu of a ball valve; an annular sample chamber might be added to tool 50 such as is also disclosed in the aforesaid U.S. Pat. No. RE 29,562; a second valve ball might be included longitudinally spaced from valve ball 330 and secured to operating mandrel 260 to form a ball-type sampler having a mechanism similar to those disclosed in U.S. Pat. Nos. 4,064,937, 4,270,610 and 4,311,197; the valve ball 330 could be placed at the top of the tool and employed for drill pipe test purposes only with another tester valve run below the tool, as has been heretofore suggested; an annular piston having a longitudinal channel therein with a resiliently biased check valve closure member and valve seats at each end thereof may be substituted for the piston sleeve and pistons of the preferred embodiment, using for stop means a pin or rod adapted to push the check valve closure member back from its seat at each limit of piston travel to dump fluid therepast. These and other changes may be effected without departing from the spirit and scope of the claimed invention:

I claim:

1. A tool for use in a testing string disposed in a well bore, comprising:

tubular housing means defining a longitudinal tool bore;

valve menas including a tool bore closure valve disposed in said housing means;

operating means, including mandrel means, adapted to selectively open and close said tool bore closure valve in response to sequential changes in pressure proximate said tool in said well bore; and ratchet means associated with said mandrel operating means or controlling said selective opening and closure of said tool bore closure means pursuant to a program.

2. The apparatus for claim 1, wherin said ratchet means rogram is defined by the configuration of a continuous slot and said slot includes at least one program position in said slot configuration hereby said tool bore closure valve is disconnected from said mandrel means and subsequently reconnected thereto.

3. The apparatus of claim 2, wherein said tool bore closure valve is disconnnected in its open position from said mandrel means, whereby said well bore pressure can be changed at least two times to said reconnection.

4. The apparatus of claim 1, wherein said tool bore closure valve comprises a ball valve rotatable to block said tool bore responsive to movement of said mandrel means.

5. A testing tool for use in a well bore, comprising:

tubular housing means defining a longitudinal tool bore;

mandrel means slidable disposed in said tool bore;

a tool bore closure valve adapted to block said tool bore respective to longitudinal movement of said mandrel means; and operating means adapted to effect said longitudinal mandrel means movement in response to pressure changes in said well bore, said operating means further including lost motion means to selectively disconnect said tool bore closure valve from and reconnect said tool bore closure valve to said mandrel means.

6. The apparatus of claim 5, wherein said said lost motion means comprises ratchet means having a continuous slot, the configuration of which defines a program for the operation of said tool bore closure valve and said disconnection and reconnection of said tool bore closure valve from and to said mandrel means.

7. The apparatus of claim 6, wherein said slot program is adapted to disconnect said tool bore closure valve from said mandrel means after the former is placed in an open position, and to reconnect said tool bore closure valve to said mandrel means after a sequence of not less than two pressure changes in said well bore.

8. the apparatus of claim 5, wherein said tool bore closure valve comprises a ball valve rotatable to block said tool bore responsive to movement of said mandrel means.

9. A method of operating a testing tool having a longitudinal bore therethrough, comprising:

running said tool into a well bore on a pipe string;

opening a tool bore closure valve disposed in said tool bore responsive to an increase in pressure in said well bore;

reducting said well bore pressure without closing said tool bore closure valve;

increasing said well bore pressure a second time;

reducing said well bore pressure a second time; and closing said tool bore closure valve in respònse to said second reduction in well bore pressure.

* * * * *